US011199381B2

(12) United States Patent
Yim et al.

(10) Patent No.: US 11,199,381 B2
(45) Date of Patent: Dec. 14, 2021

(54) LANDMINE EXCABATOR AND NEUTRALIZER AND RELATED METHODS

(71) Applicant: Demine Robotics Inc., Waterloo (CA)

(72) Inventors: Prosithyrith Yim Yim, Toronto (CA); Christian Joseph Lee, Brampton (CA); Baruch Chung-Kay Chau, Brampton (CA); Ming Xinchi Hu, London (CA); Jonathan Jiayu Deng, Chilliwack (CA); Brian Yi Liu, Waterloo (CA); Daniel Alan Saunders, Waterloo (CA)

(73) Assignee: Demine Robotics Inc., Waterloo (CA)

( * ) Notice: Subject to any disclaimer, the term of this patent is extended or adjusted under 35 U.S.C. 154(b) by 0 days.

(21) Appl. No.: 16/468,704

(22) PCT Filed: Dec. 12, 2017

(86) PCT No.: PCT/CA2017/051506
§ 371 (c)(1),
(2) Date: Jun. 12, 2019

(87) PCT Pub. No.: WO2018/107285
PCT Pub. Date: Jun. 21, 2018

(65) Prior Publication Data

US 2020/0096295 A1 Mar. 26, 2020

Related U.S. Application Data

(60) Provisional application No. 62/433,404, filed on Dec. 13, 2016.

(51) Int. Cl.

| | |
|---|---|
| ***F41H 11/24*** | (2011.01) |
| ***F41H 11/26*** | (2011.01) |
| ***F42B 33/06*** | (2006.01) |

(52) U.S. Cl.
CPC ..... *F41H 11/24* (2013.01); *F41H 11/26* (2013.01); *F42B 33/06* (2013.01)

(58) Field of Classification Search
CPC ..... F41H 11/20; F41H 11/26; F41H 11/24; F41H 11/12; F41H 11/13; F41H 11/138; F41H 11/16; F42B 33/06
See application file for complete search history.

(56) References Cited

U.S. PATENT DOCUMENTS 4,652,204 A 3/1987 Arnett
5,281,079 A 1/1994 Lemelson
(Continued)

FOREIGN PATENT DOCUMENTS

CN 102607333 A1 7/2012

OTHER PUBLICATIONS

International Search Report and Written Opinion issued by the International Searching Authority in relation to corresponding PCT Application No. PCT/CA2017/051506, dated Feb. 27, 2018, 5 pgs.

*Primary Examiner* — J. Woodrow Eldred

(57) ABSTRACT

Clearing landmines is a dangerous activity and the danger is increased when trying to clear a landmine without triggering an explosion. An excavator for landmines is provided, which includes a first actuator that vertically moves a mounting plate. Two or more secondary actuators are mounted to the mounting plate, and each of the secondary actuators are able to extend and retract a tool. Each respective tool has drill bits or prongs for penetrating a ground surface. A neutralizer is also provided, and it includes: a robotic clamp to grip a landmine and to reposition the same; a cutting tool to cut an opening into the landmine; a steaming module to eject steam into the opening; and a catcher to collect melted explosive material that exits the landmine.

18 Claims, 29 Drawing Sheets

(56) References Cited

U.S. PATENT DOCUMENTS

| | | | | |
|---|---|---|---|---|
| 5,936,185 | A * | 8/1999 | Tokuni | E02F 3/20 102/402 |
| 2004/0069508 | A1 * | 4/2004 | Lowery | F41H 11/20 171/19 |

* cited by examiner (208, 209, 210, 211)

LANDMINE EXCABATOR AND NEUTRALIZER AND RELATED METHODS

CROSS-REFERENCE TO RELATED APPLICATIONS

This application claims priority to U.S. Patent Application No. 62/433,404, filed on Dec. 13, 2016, and titled "Landmine Excavator and Neutralizer and Related Methods", the entire contents of which are hereby incorporated by reference.

TECHNICAL FIELD

The following relates generally to excavating a landmine, and neutralizing a landmine.

BACKGROUND

Landmines are explosive devices that are laid on or just below the ground surface. The landmines are designed and placed so that, when a person or a vehicle applies pressure on top of a landmine, the explosive material within detonates to cause physical harm. There are estimates that over 100 million landmines have been placed around the world since the 1960s. Unfortunately, after a battle or war is over, the landmines remain in place, causing death and injury to civilians While the placing and arming of mines is relatively inexpensive and simple, the process of detecting and removing them is typically expensive, slow, and dangerous. This is especially true of irregular warfare where mines were used on an ad hoc basis in unmarked areas. Anti-personnel mines are most difficult to find, due to their small size and the fact that many are made almost entirely of non-metallic materials specifically to escape detection.

Currently, landmine clearance techniques include people manually excavating and defusing landmines. This is a very dangerous effort, which often leads to volunteers being injured or to fatalities.

Mechanical demining techniques include using armored vehicles, such as a bulldozer, that are equipped with a flail or roller. In military demining efforts, carpet bombs or fires are set to explode the mines. Many of these techniques destroy the land around the landmines, making the land unusable or unsuitable for civilians to use.

BRIEF DESCRIPTION OF THE DRAWINGS

Embodiments will now be described by way of example only with reference to the appended drawings wherein.

DETAILED DESCRIPTION

Figure 1:
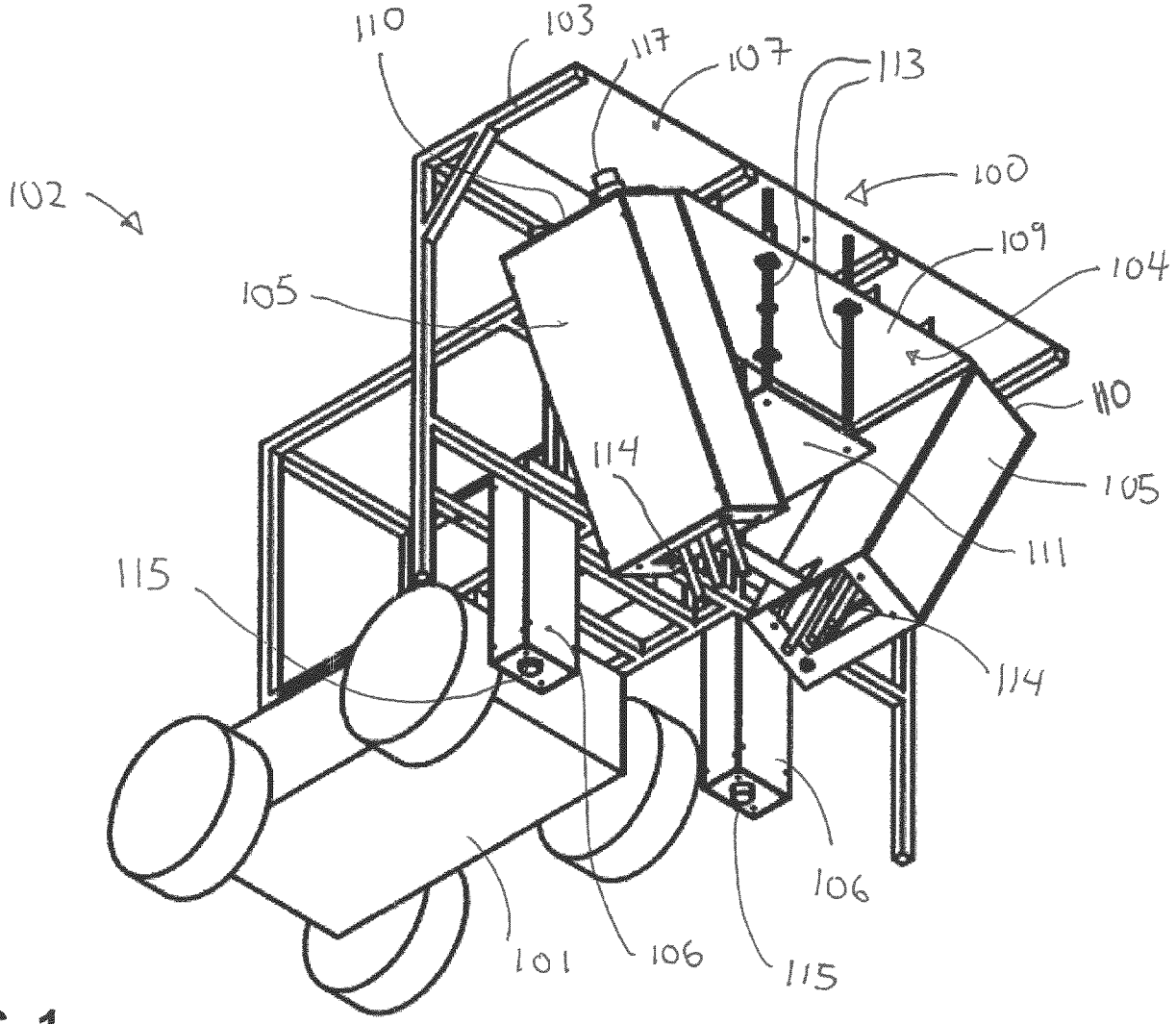
FIG. 1 is a bottom perspective view of an excavation mechanism mounted on a vehicle, according to an example embodiment.
Figure 2:
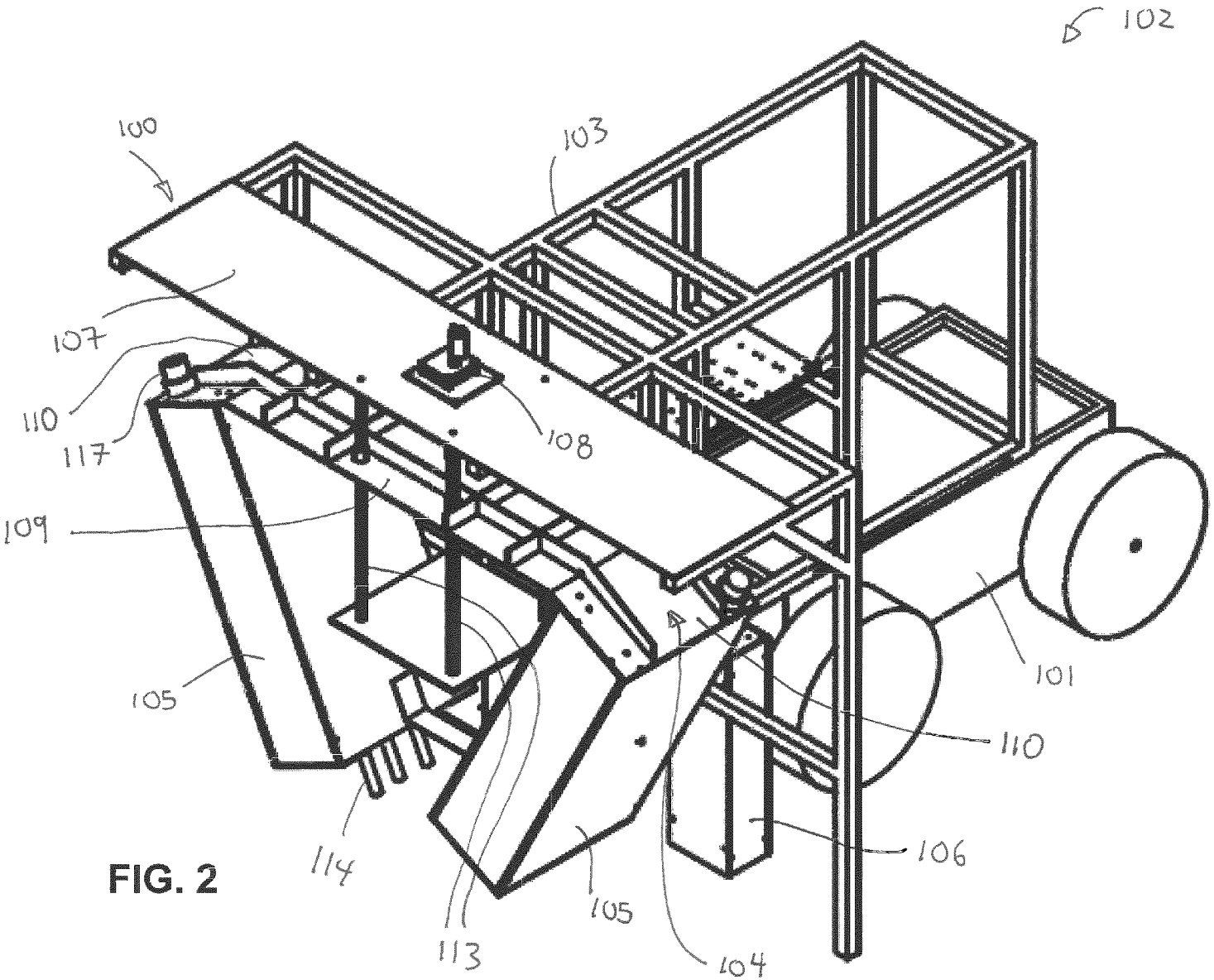
FIG. 2 is a top perspective view of the excavation mechanism shown in FIG. 1.
Figure 3:
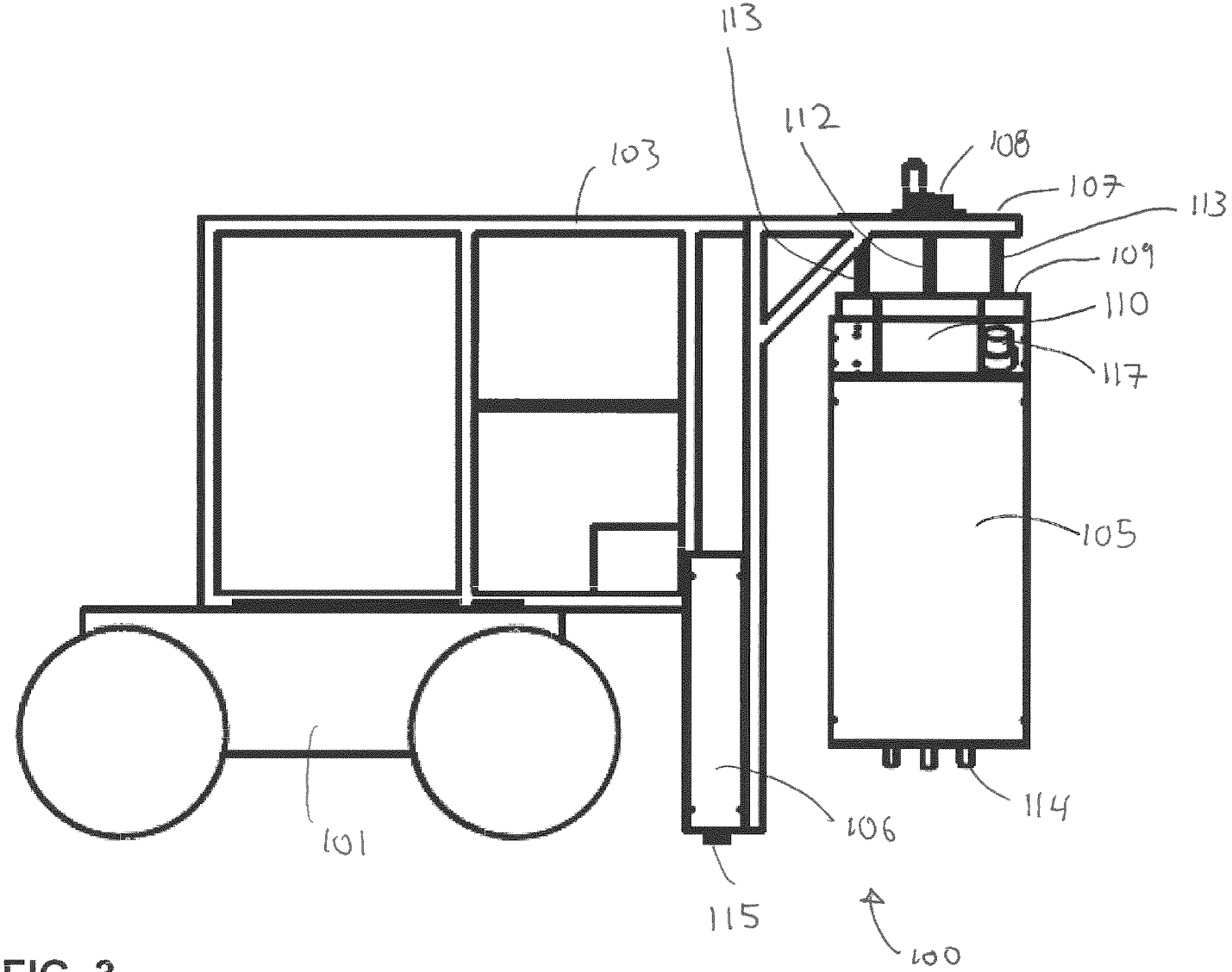
FIG. 3 is a side view of the excavation mechanism shown in FIG. 1.
Figure 4:
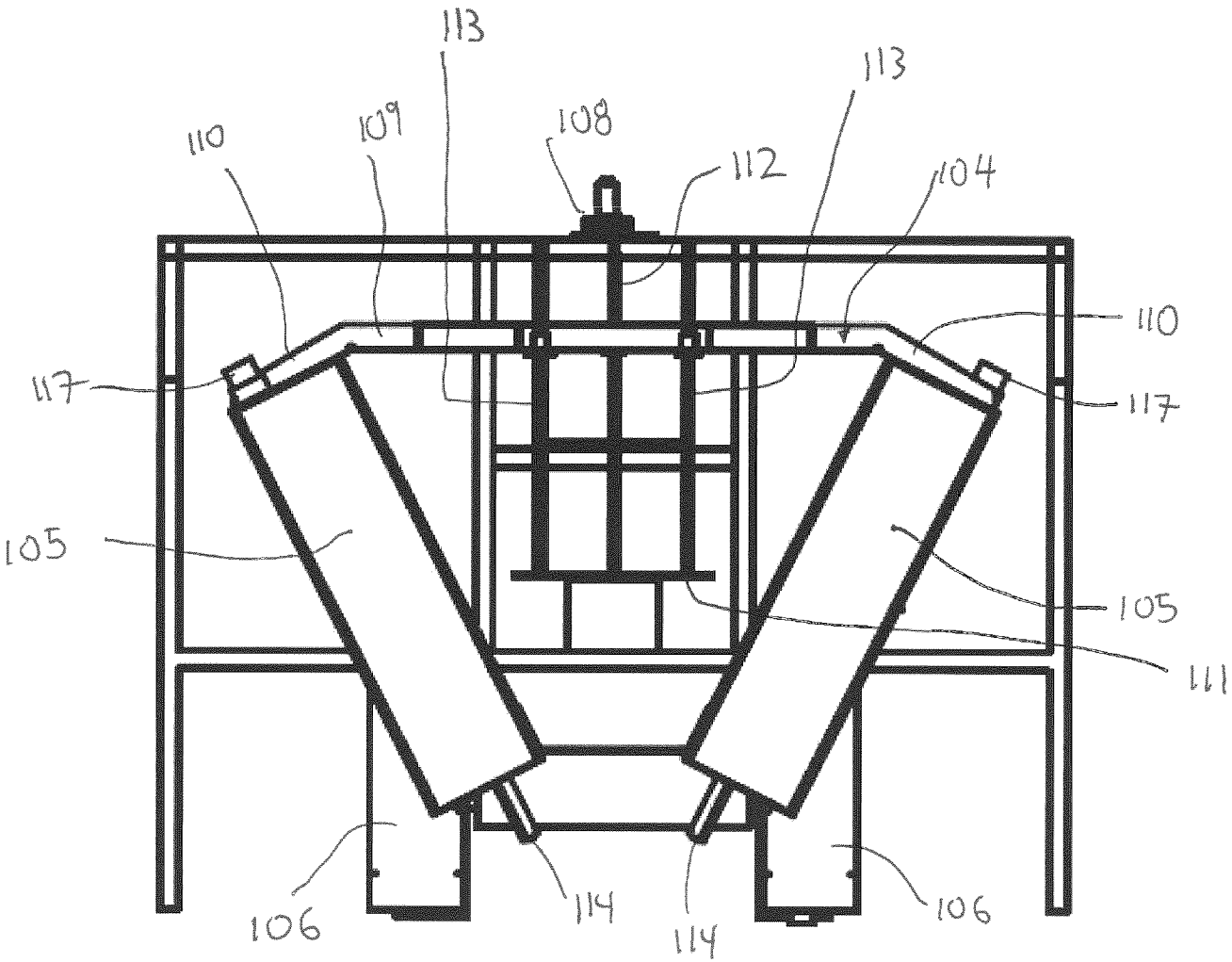
FIG. 4 is a front view of the excavation mechanism shown in FIG. 1.
Figure 5:
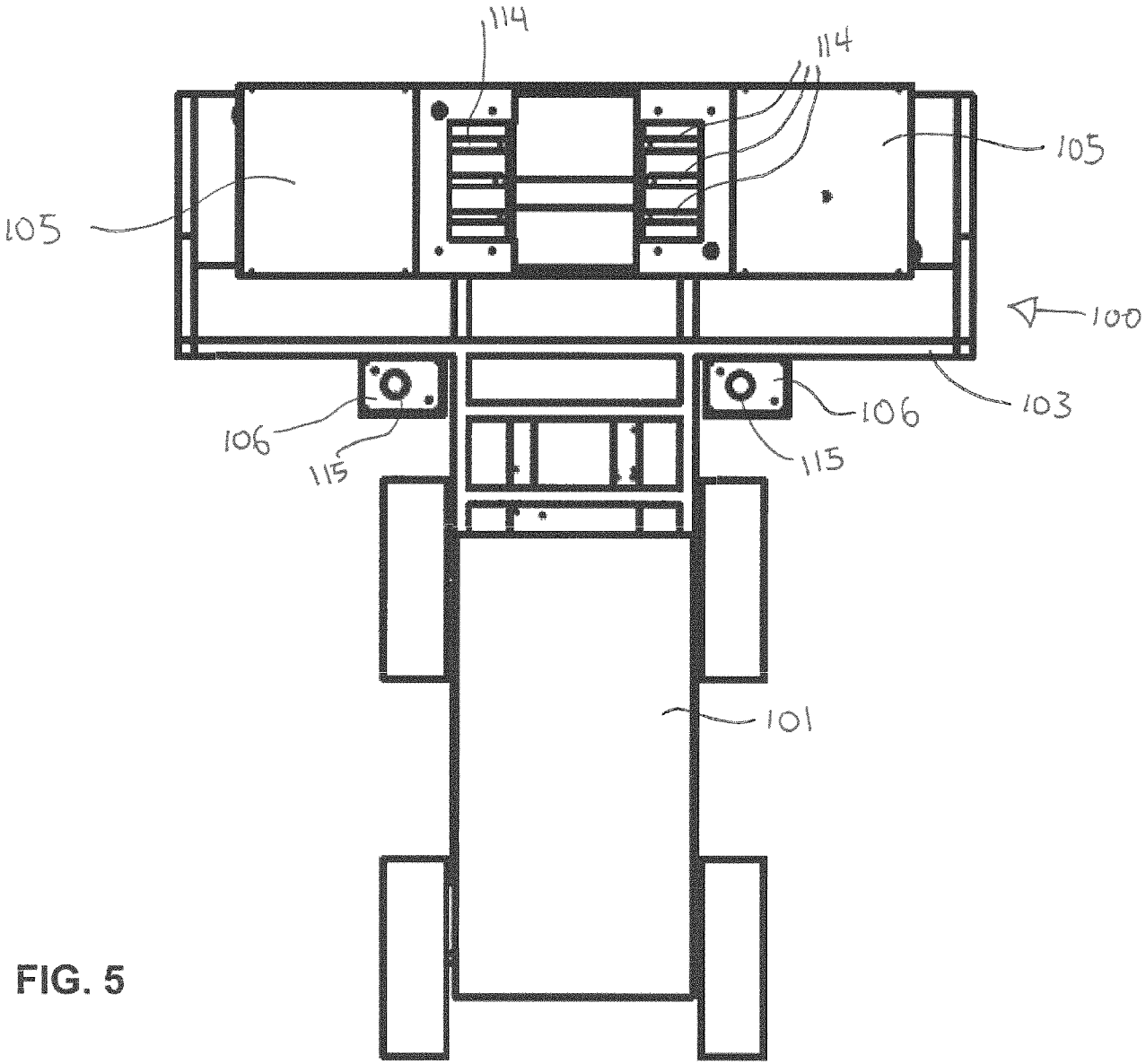
FIG. 5 is a bottom view of the excavation mechanism shown in FIG. 1.
Figure 6:
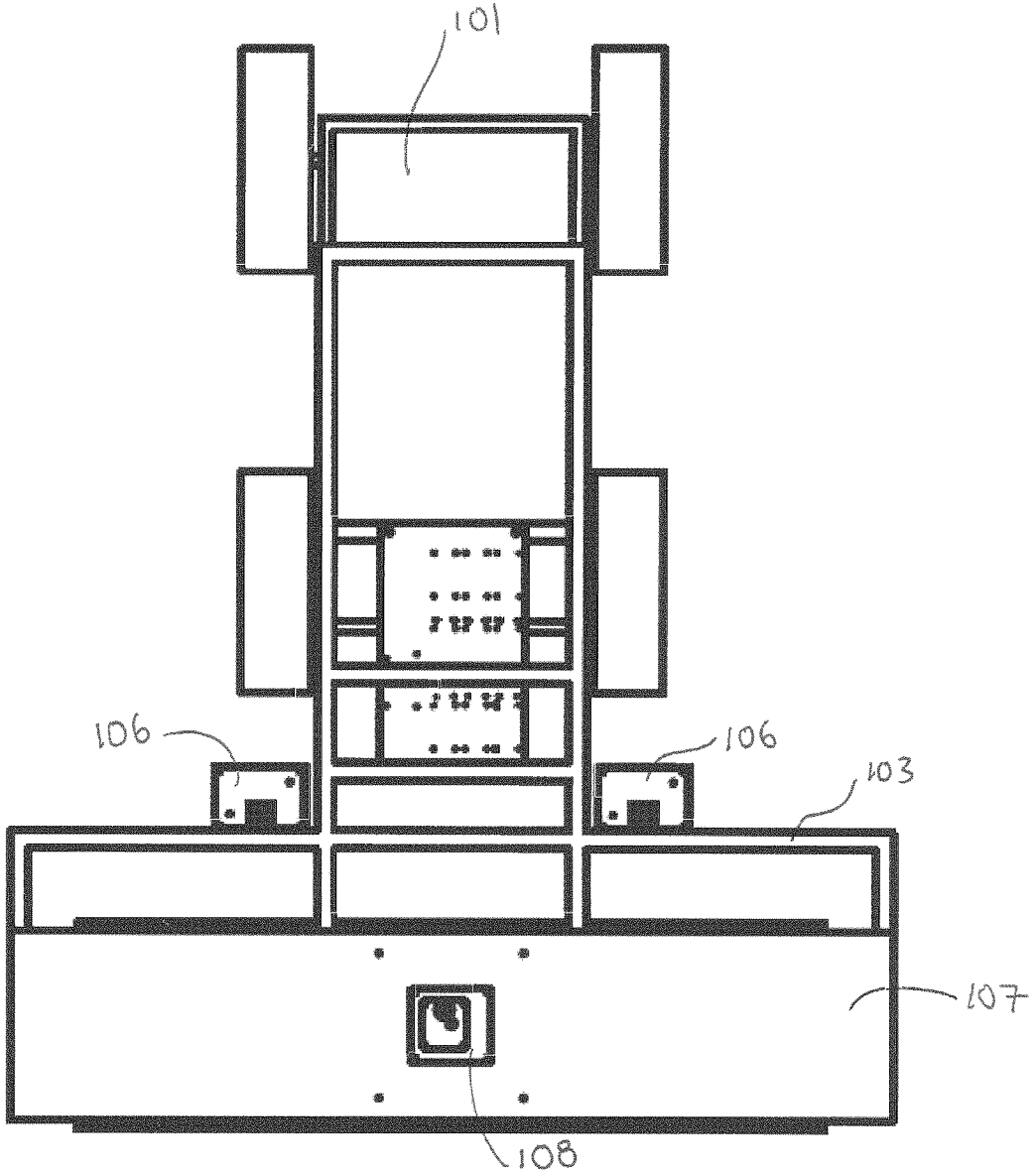
FIG. 6 is a top view of the excavation mechanism shown in FIG. 1.
Figure 8:
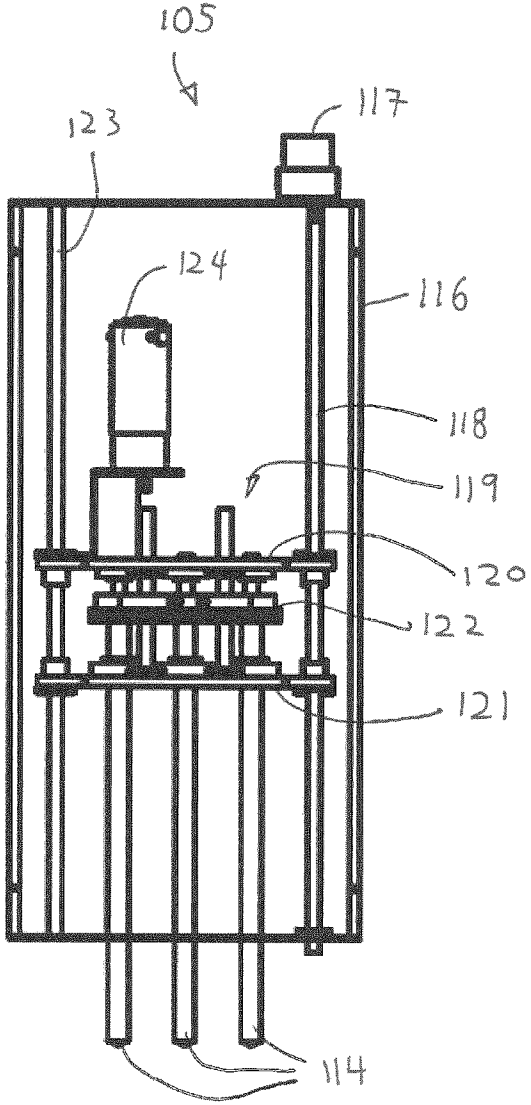
FIG. 8 is a profile view of the tool module shown in FIG. 7.
Figure 7:
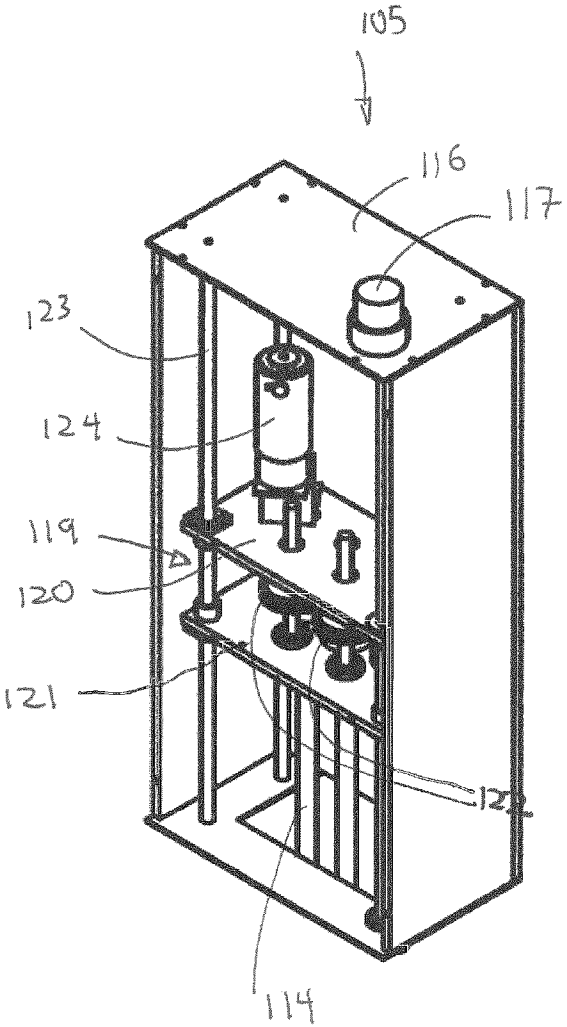
FIG. 7 is a perspective view of a tool module that is part of the excavation mechanism, according to an example embodiment.
Figure 10:
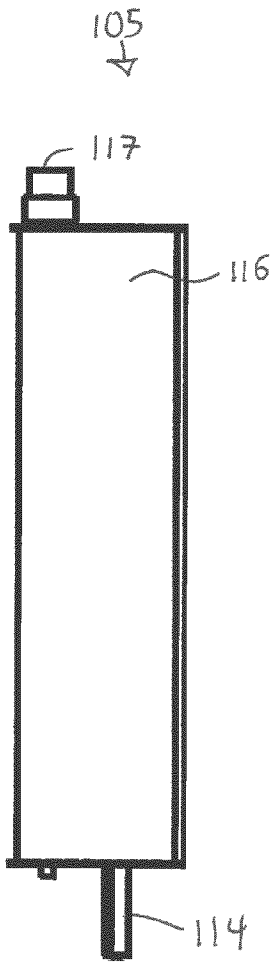
FIG. 10 is a side view of the tool module shown in FIG. 7.
Figure 9:
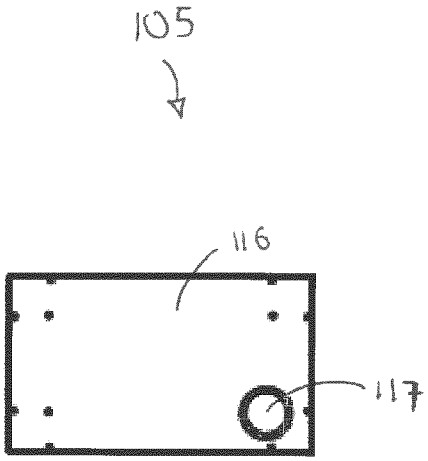
FIG. 9 is a top view of the tool module shown in FIG. 7.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

In a general example embodiment, an excavator is provided to extract a landmine from a ground surface. It can be appreciated that a landmine is positioned on the ground surface, or is buried just below the ground surface.

The excavator is a machine that digs out a section of the earth where the landmine is buried. It includes multi-pronged digging tools that require less force to insert into the ground, and when lifting the landmine, the tools allow dirt to fall through to isolate the landmine.

As shown in FIGS. 1 to 6, an example embodiment of a machine 102 includes the excavator system 100 and the mobile platform 101. In the example shown, the mobile platform 101 is a four wheeled machine which supports and drives the excavator system 100 to the position of the ordinance. In an example embodiment, the mobile platform 101 or the excavator system 100, or both, are remotely controlled by a person. In another example embodiment, the mobile platform 101 or the excavator system 100, or both, are autonomous. In yet another example embodiment, the mobile platform 101 or the excavator system 100, or both, have the capability to switch from a fully autonomous mode to a semi-autonomous mode, in which a person can remotely control aspects of the machine.

While a wheeled vehicle is shown in the figures, it will be appreciated that other types of mobile platforms or other types of vehicles could be used to support and move the excavator system 100.

The excavator system 100 includes a frame 103 that supports a mounting plate 104, and the mounting plate 104 has mounted thereon two penetrating drill modules 105. The frame also supports two land anchor modules 106.

The frame 103 or the mobile platform 101 itself support an electronic controller and a power supply that respectively controls and powers the motors and actuators of the excavator system 100. For example, the controller and the power supply are positioned within the mobile platform 101. In another example, the controller and the power supply are positioned external to the mobile platform for easier access. The power supply, for examples, includes batteries. In an example embodiment, the controller includes a communication system, a processor, memory for storing processor executable instructions, and electronic interfaces to interface with various components (e.g. linear actuators, motors, etc.). The communication system, for example, transmits data wirelessly. In another example, the communication system transmits data over wires. In an alternative example, the controller does not include a processor and memory for storing executable instructions; instead it receives and relays control signals to control various components in the excavator system 100.

The land anchor modules 106 are able to physically drive corkscrews 115 into the ground in order to anchor the excavator system 100. The entire frame mounting plate 104 and the drill modules 105 vertically translate downwards to the ground, and the drill modules 105 extend inwards and downwards (e.g. at an angled slant) so that the drill bits 114 drill into the ground, around and below a landmine that is buried in the ground. In an example embodiment, each drill module 105 has three drill bits 114. However, other example embodiments could have more or less drill bits.

It can be appreciated that there are one or more land anchor modules 106. It can also be appreciated that other shapes of tools could be used, in alternative to a corkscrew shape, to hook or embed into the ground to act as a ground anchor.

The frame 103 supports a fixed support plate 107. The fixed support plate 107 in turn supports a linear actuator that moves the mounting plate 104 up and down. In an example embodiment, the linear actuator is a motor 108 that rotates a threaded rod 112. The threaded rod 112 is mechanically connected to a threaded interior surface of a hole (e.g. a threaded interior surface of a nut) defined in a center portion 109 of the mounting plate 104. Therefore, when the threaded rod 112 rotates or spins, the entire mounting plate 104 travels up or down the threaded rod 112. In other words, the mounting plate 104 moves away from (e.g. downwards) or closer towards (e.g. upwards) the fixed support plate 107.

Figure 11:
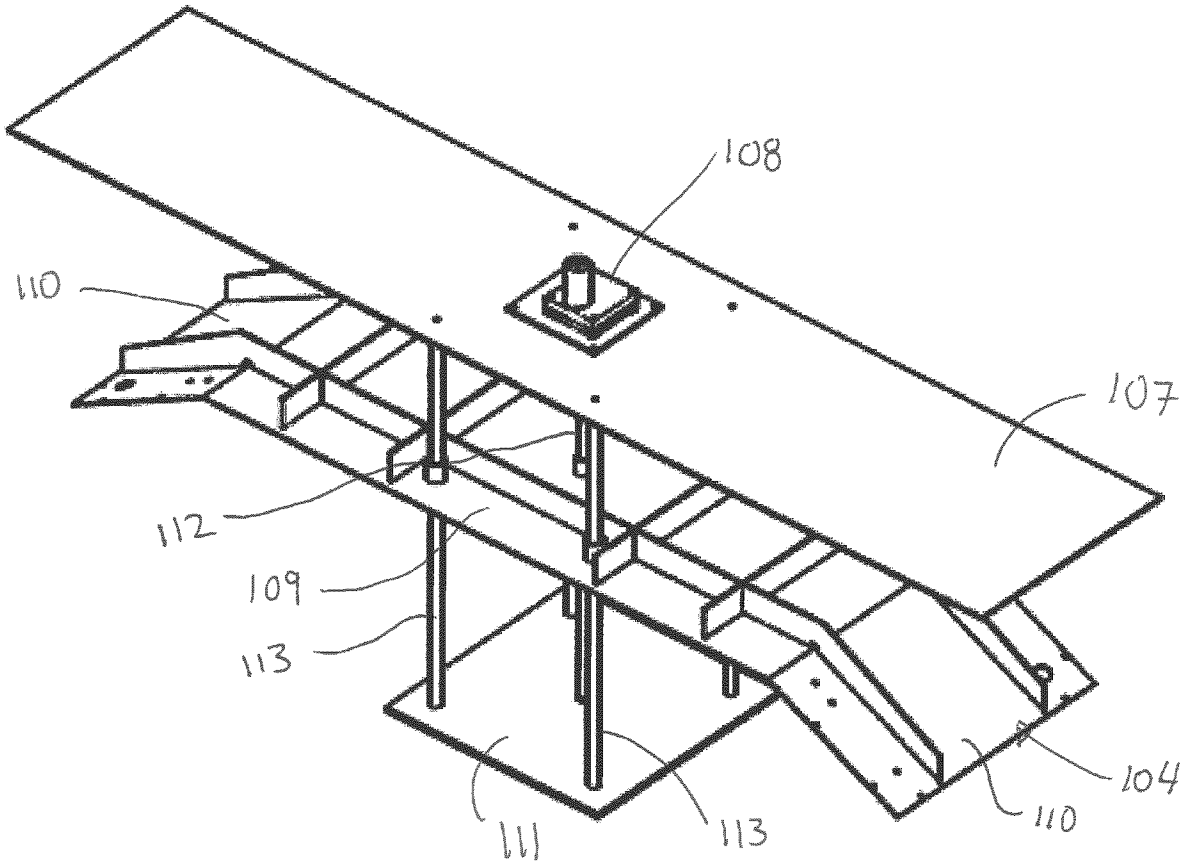
FIG. 11 is a top perspective view of a mounting plate that is part of the excavation mechanism, according to an example embodiment.
Figure 12:
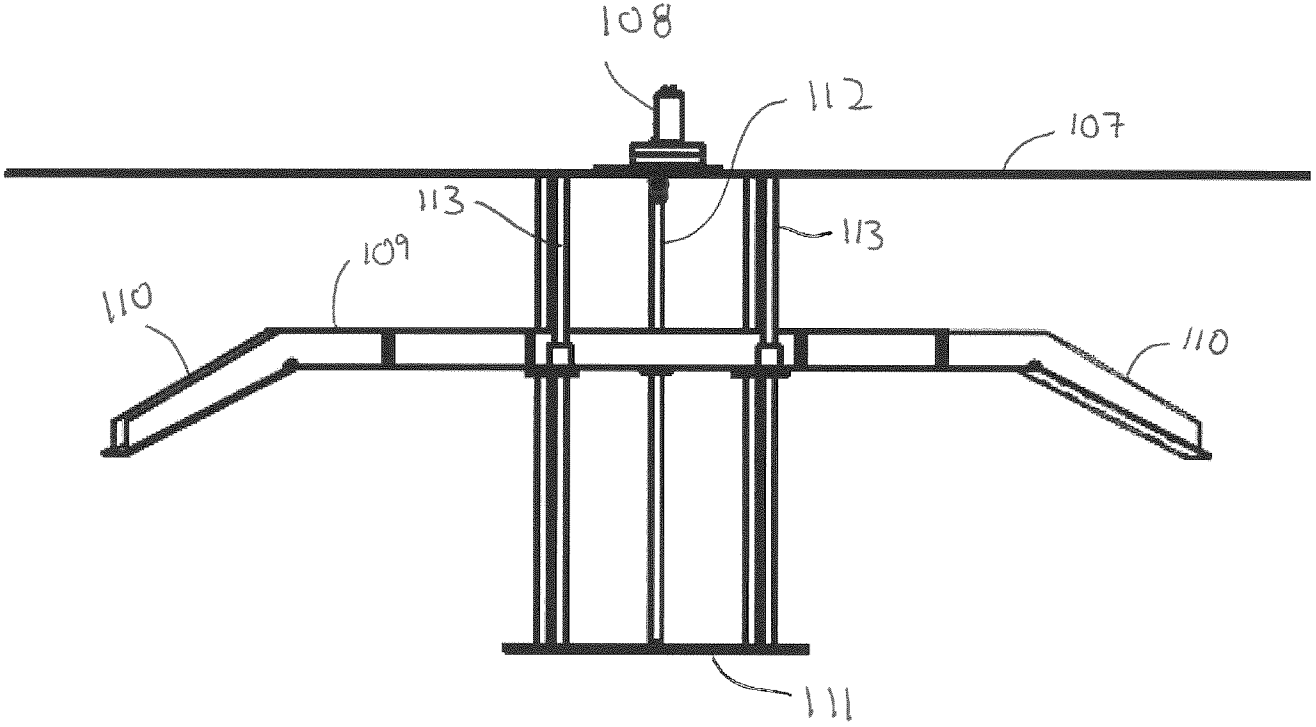
FIG. 12 is a front view of the mounting plate shown in FIG. 11.

As also shown in FIGS. 11 and 12, the motor 108 is mounted to the fixed support plate 107, and one end of threaded rod 112 is mounted to the fixed support plate 107. The end of the threaded rod 112 that is mounted to the fixed support plate is still able to rotate along its axis. Multiple support rods 113 (e.g. four support rods) are fixed to and extend from the fixed support plate 107 to a stabilizing structure 111 located below the mounting plate 104. The support rods 113 are also fixed on their opposite ends to the stabilizing structure. The support rods are smooth and pass through holes defined in the mounting plate 104, so that the mounting plate 104 can slide up and down these support rods 113. The support rods 113 prevent the mounting plate 104 from twisting while the threaded rod 112 is being turned, so that the mounting plate 104 is driven up or down.

It will be appreciated that other types of currently known and future known linear actuators that are able to move the mounting plate 104 up and down are applicable to the excavator system 100.

The mounting plate 104 includes the center portion 109 and two outer portions 110 that flank the center portion 109. The center portion 109 is horizontally oriented and the outer portions are angled downwards and inwards to each other. The outer portions 110 each support a penetrating drill module 105. Each penetrating drill module is oriented at a downward and inward angle corresponding to the angle of the outer portions.

Turning to FIGS. 7-10, more detailed views of a penetrating drill module 105 is provided. The drill module 105 includes a housing 116. The housing 116 supports a linear actuator that moves a drill tip assembly 119 up and down within the housing 116. The drill tip assembly 119 includes the drill bits 114 and a motor 124 for driving the drill bits 114. In particular, the drill tip assembly includes a first supporting plate 120 and a second supporting plate 121. These supporting plates 120 and 121 support a motor 124, a gear assembly 122, and the drill bits 114. In particular, the motor 124 drives the gear assembly 122, and the gear assembly drives the drill bits 114.

Each of the first and the second supporting plates 120, 121 have holes defined therein, through which one or more support rods 123 slide through. For example, there are three support rods 123. In an example embodiment, linear bearings on the plates 120, 121 line the holes, and the linear bearings slide over the support rods.

In an example embodiment, the linear actuator that moves the drill tip assembly up and down includes a motor 117 mounted to the housing 116. The motor 117 drives a threaded rod 118. In particular, one end of the threaded rod 118 is fixed to housing 116, while still being able to rotate about its axis as it is driven by the motor 117. The opposite end of the threaded rod is free or unattached.

The threaded rod 118 is mechanically connected to a threaded interior surface of respective holes (e.g. a threaded interior surface of a nut) defined in each of the first and the second supporting plates 120, 121. Therefore, when the threaded rod 118 rotates or spins, the entire drill assembly 119 travels up or down the threaded rod 118.

It will be appreciated that other types of linear actuators to move the drill assembly 119 up and down within the enclosure are applicable to the drill module 105.

Figure 13:
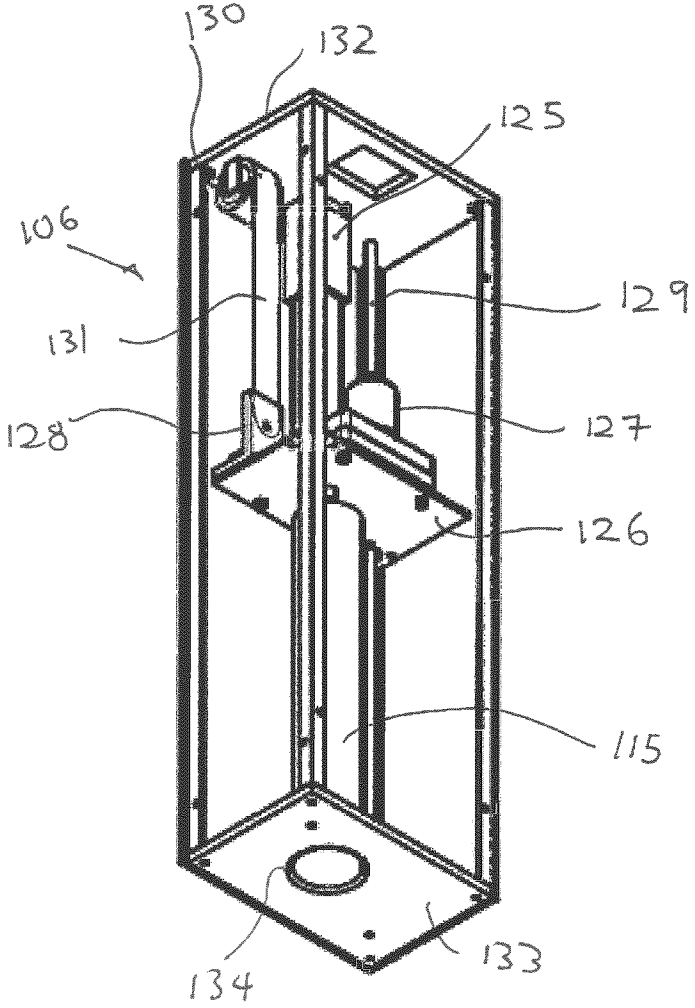
FIG. 13 is a perspective view of a land anchor module that is part of the excavation mechanism, according to an example embodiment.
Figure 15:
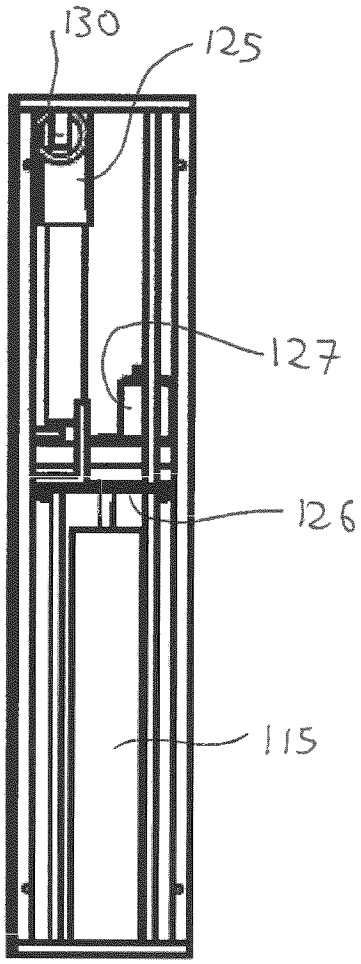
FIG. 15 is a side view of the land anchor module shown in FIG. 13.
Figure 14:
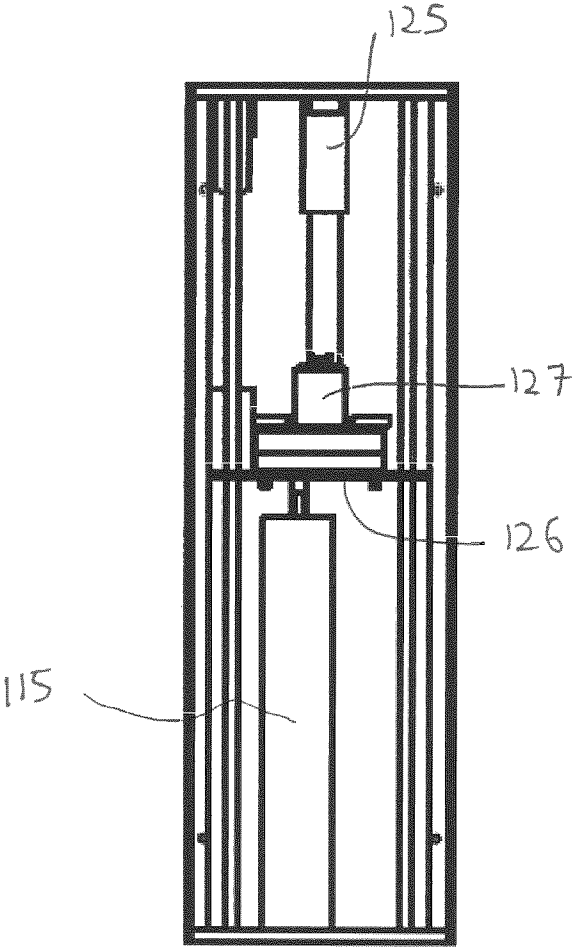
FIG. 14 is a front view of the land anchor module shown in FIG. 13.

Turning to FIGS. 13 to 15, more detailed views of a land anchor module 106 are provided. The land anchor module 106 includes a supporting platform 126 that moves up and down within the housing of the land anchor module 106. The platform 126 supports a motor 127, a corkscrew 115, and an attachment bracket 128. The motor 127 drives the corkscrew 115 so that it spins. The attachment bracket 128 is connected to one end of a spring 131, while the other end of the spring is connected to an anchor 130 fixed to the housing (e.g. interior surface of the housing plate 132). The platform 126 also defines therein a hole, and a stabilizing rod 129 passes through the hole. The platform 126 slides up and down the stabilizing rod 129. In an example embodiment, a linear bearing lines the hole so that the linear bearing slides up and down the stabilizing rod 129. The stabilizing rod 129 is fixed at both ends to the housing, for example, to one housing plate 132 and to another oppositely positioned housing plate 133.

A linear actuator 125 is mounted to the interior surface of the housing plate 132. The linear actuator 125 pushes down on the platform 126 to force the corkscrew 115 into the ground. The end of the linear actuator 125 that pushes against the platform 126 is not connected to the platform 126. The platform is pulled back up using the spring 131. In an example embodiment, the spring 131 is a coil spring that is rolled around the anchor 130. It can uncoil in the extended position, and coil back in the retracted position. The spring 131 is sufficiently strong enough pull back the mass of the platform 126 and the components mounted to the platform. Therefore, when the linear actuator 125 is retracted and the corkscrew 115 is not anchored to the ground, the spring 131 retracts the spring into the housing of the land anchor module 106. Other types of springs that could extend and resiliently retract to pull back the mass of the platform 126 and the components mounted thereon are applicable to the land anchor module 106.

In operation, the linear actuator 125 pushes the platform 126 and, thus, the corkscrew 115 into the ground. The corkscrew passes through an opening 134 defined in the housing plate 134. The motor 127 drives the corkscrew 115, so that it spins and catches with ground. After the corkscrew catches the ground, the linear actuator 125 retracts. In this state the spring 131 is still extended. After the corkscrew releases itself from the ground (e.g. by driving the motor 127 in the opposite direction), the corkscrew 115 and the entire platform 126 automatically retract upwards under the force of the spring 131.

Figure 16:
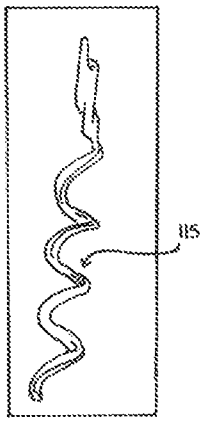
FIG. 16 is an example embodiment of a cork screw used in the land anchor module.
Figure 17:
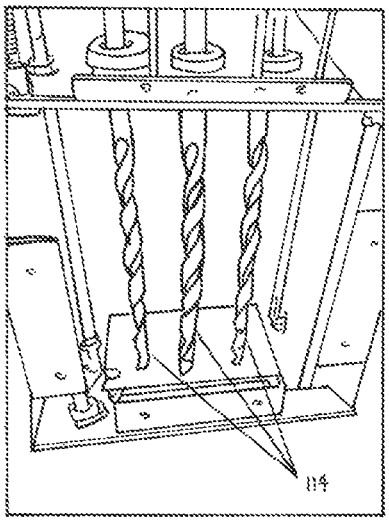
FIG. 17 is an example embodiment of the drill bits used in the tool module.

FIG. 16 shows an example embodiment of a corkscrew 115. FIG. 17 shows an example embodiment of the drill bits 114 used in a drill module.

Figure 18A:
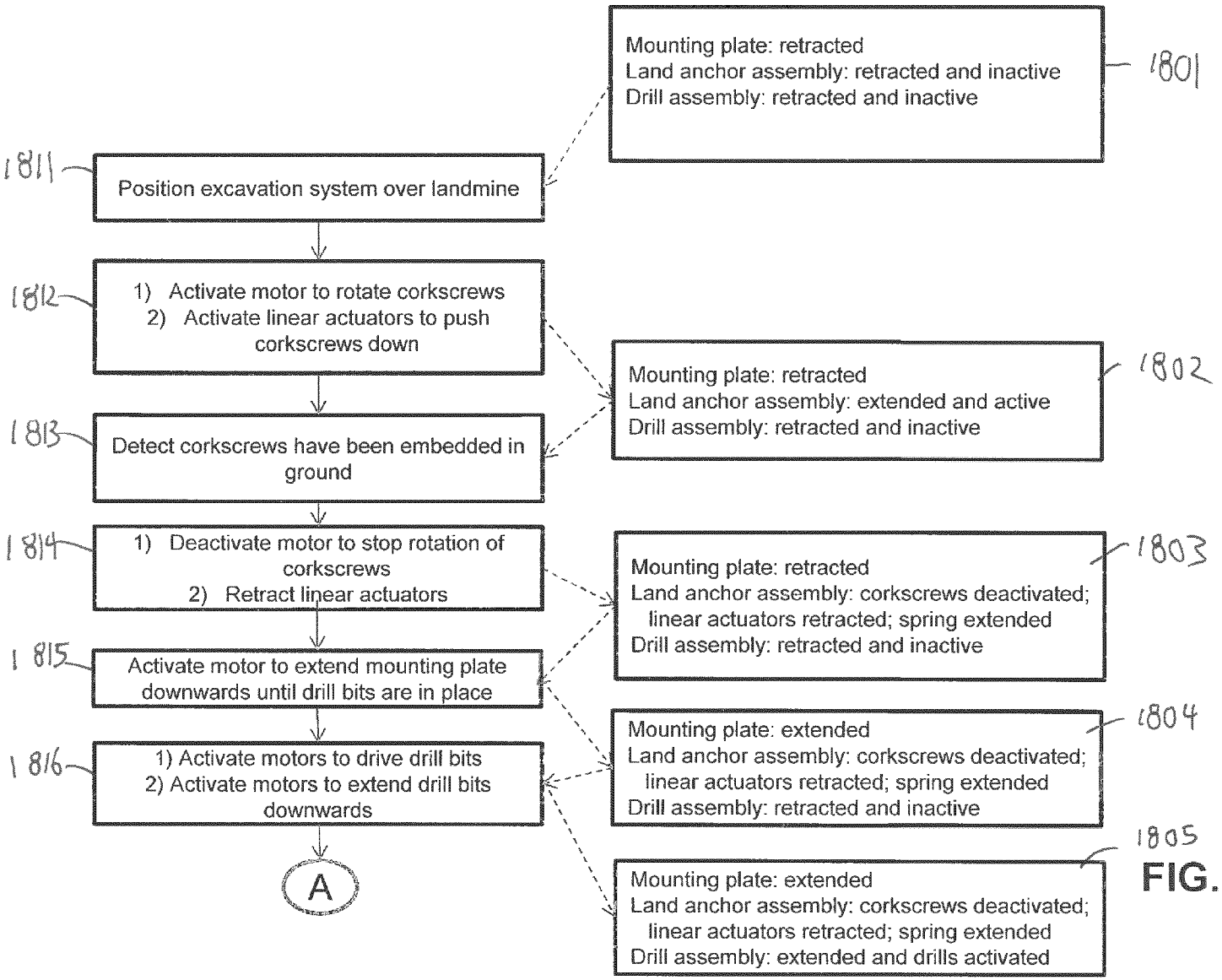
FIGS. 18*a* and 18*b* shows example operations of the excavation mechanism.
Figure 18B:
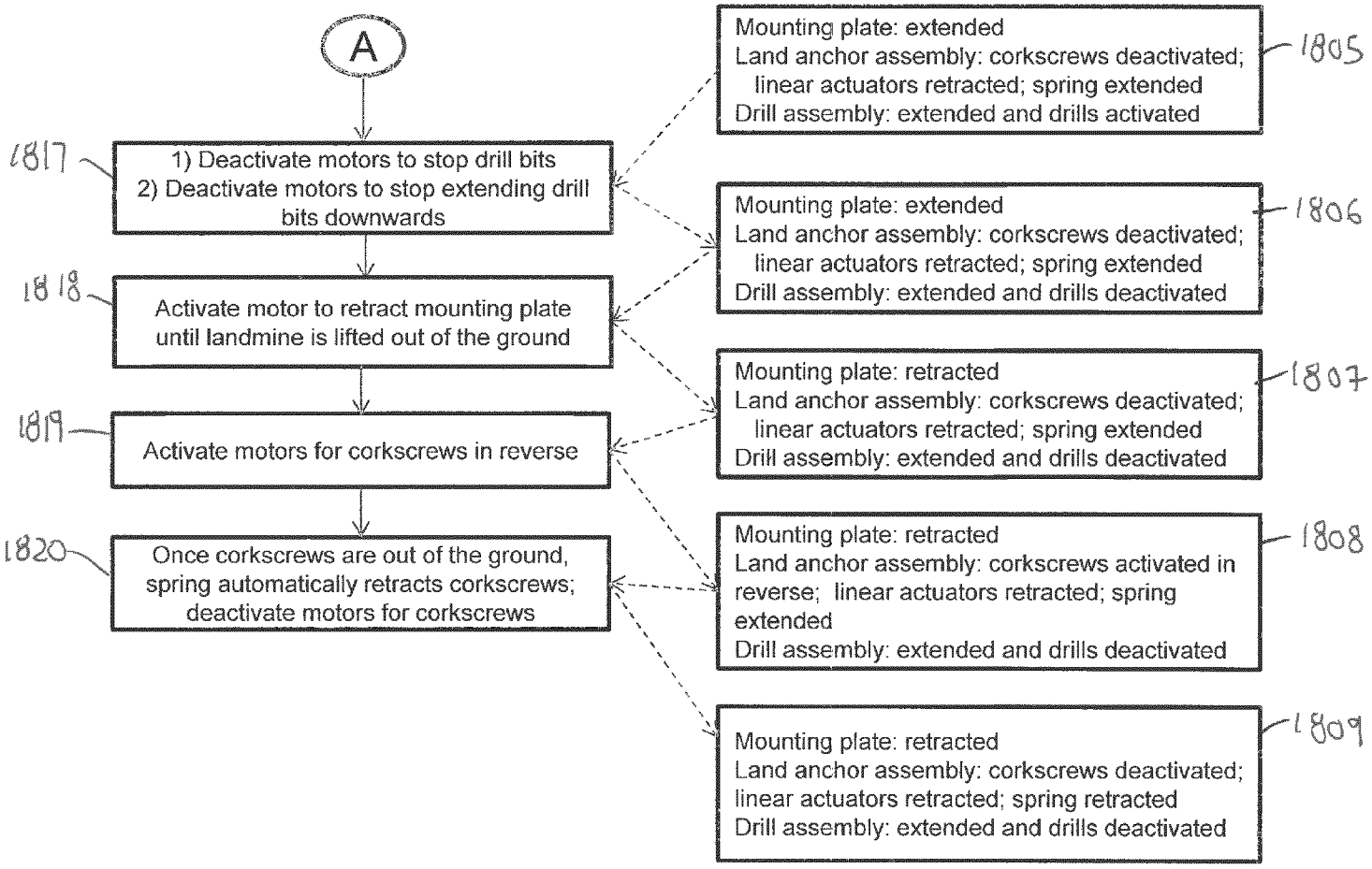

Turning to FIGS. 18*a* and 18*b*, blocks 1801 to 1809 show various states of the excavator system 100. Blocks 1811 to 1820 show operations, for example, that are executable by the electronic controller. These operations, for example, are processor executable instructions stored in memory within the controller. In another example, these operations are processor executable instructions that are transmitted to the controller via its communication system. In another example, these operations are control signals received by the controller that in turn control the excavator system 100.

At block 1801, the initial state of the excavator system includes: the mounting plate 104 being retracted; the land anchor module 106 (particularly the corkscrew 115) being in a retracted and inactive; and the drill module (particularly the drill bits 114) being retracted and inactive.

At block 1810, there is a control command to position the mobile platform 101 so that the excavation system 100 is positioned over the landmine.

At block 1811, there is a control command to activate the motor 127 to rotate the corresponding corkscrew 115, and to activate the linear actuator 125 to push the corresponding corkscrew 115 down. This occurs for both land anchor modules.

As a result, the state transitions to block 1802, which includes: the mounting plate 104 in a retracted state; the corkscrews of the land anchor modules being extended and active (e.g. actively rotating); and the drill bits being retracted and inactive.

At block 1813, the controller or the remote operator detects that the corkscrews have been embedded into the ground. At block 1814, there is a control command to deactivate the motor 127 to stop the corresponding rotation of the corkscrew 115, and to retract the linear actuator 125. This occurs for both land anchor modules.

The state then transitions to block 1803, which includes: the mounting plate 104 in a retracted state; the motor 127 for the corkscrew 115 deactivated; the linear actuator 125 retracted; the spring 131 extended; and the drill bits being retracted and inactive.

At block 1815, there is a control command to activate the motor 108 to extend the mounting plate 104 downwards until the drill bits are in place.

The state then transitions to block 1804, which includes: the mounting plate 104 in an extended state; the motor 127 for the corkscrew 115 deactivated; the linear actuator 125 retracted; the spring 131 extended; and the drill bits being retracted and inactive.

At block 1816, there is a control command to activate the motor 124 to drive the drill bits 114 in each drill module 105, and to activate the motor 117 in each drill module 105 to extend the drill assembly 119 with the drill bits 114 downwards.

The state then transitions to block 1805, which includes: the mounting plate 104 in an extended state; the motor 127 for the corkscrew 115 deactivated; the linear actuator 125 retracted; the spring 131 extended; and the drill bits being extended and active.

At block 1817, there is a control command for each drill module to deactivate the motor 124 to stop the drill bits, and to deactivate the motor 117 to stop extending the drill bits downwards. For example, this occurs after the drill bits have dug into the ground and are positioned underneath the landmine.

The state then transitions to block 1806, which includes: the mounting plate 104 in an extended state; the motor 127 for the corkscrew 115 deactivated; the linear actuator 125 retracted; the spring 131 extended; and the drill bits being extended and deactivated.

At block 1818, there is a control command to activate the motor 108 to retract the mounting plate 104 until the landmine is lifted out of the ground.

The state then transitions to block 1807, which includes: the mounting plate 104 in a retracted state; the motor 127 for the corkscrew 115 deactivated; the linear actuator 125 retracted; the spring 131 extended; and the drill bits being extended and deactivated. At this position, the landmine is being supported by the drill bits 114.

At block 1819, there is a control command to activate, for each land anchor module, the motor 127 of the corkscrew 115 in reverse.

The state then transitions to block 1808, which includes: the mounting plate 104 in a retracted state; the motor 127 for the corkscrew 115 activated in reverse; the linear actuator 125 retracted; the spring 131 extended; and the drill bits being extended and deactivated. This reverse turning digs the corkscrew 115 out from the ground, while the spring 131 exerts an upwards pulling force on the supporting plate 126 at the same time.

At block 1820, after the corkscrews 115 are out of the ground, the spring 131 automatically retracts the corkscrews 115. A control command then deactivates the motor 127 of the corkscrew in each land anchor module.

The state then transitions to block 1809, which includes: the mounting plate 104 in a retracted state; the motor 127 for the corkscrew 115 deactivated; the linear actuator 125 retracted; the spring 131 retracted; and the drill bits being extended and deactivated.

At this stage, the landmine is now being possessed above ground by the excavation system 100.

In an example embodiment, the mobile platform 101 then maneuvers away from the dug hole to an open space. The motor 108 is activated to lower the drill bits and the landmine to the ground. The motors 117 are activated in reverse, so that the drill bits 114 are retracted further back within the housing 116. As a result, the landmine is deposited on the ground.

Other operations can ensue once the landmine is on the ground to neutralize the landmine. In another example, the landmine can be placed in a reinforced container, wherein the landmine is safely detonated. In yet another example, the machine 102 delivers the landmine to another device that neutralizes the landmine.

Figure 19A:
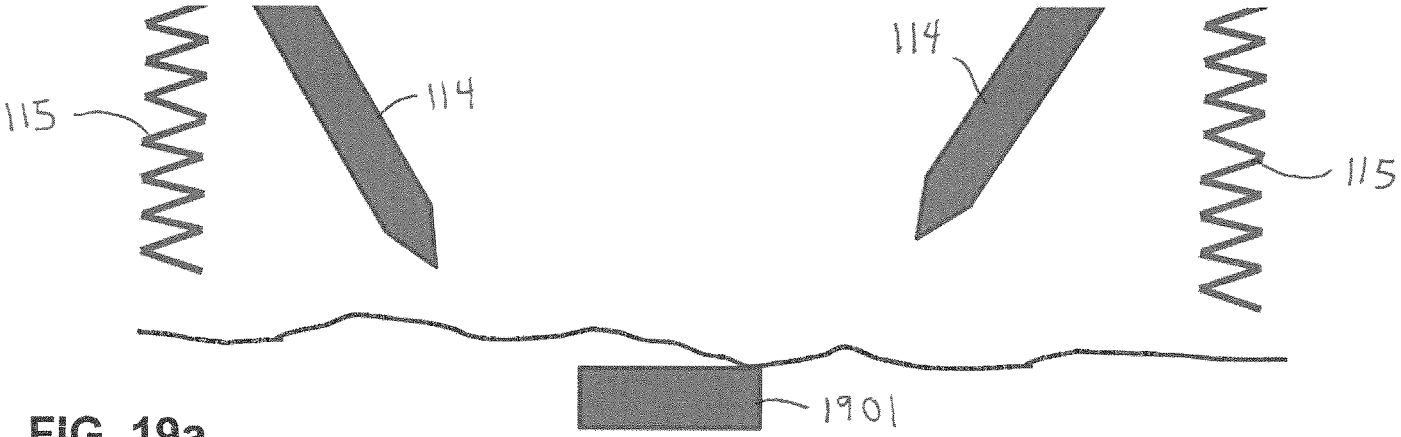
FIGS. 19*a*, 19*b*, 19*c* and 19*d* show different operations of the excavation mechanism.
Figure 19B:
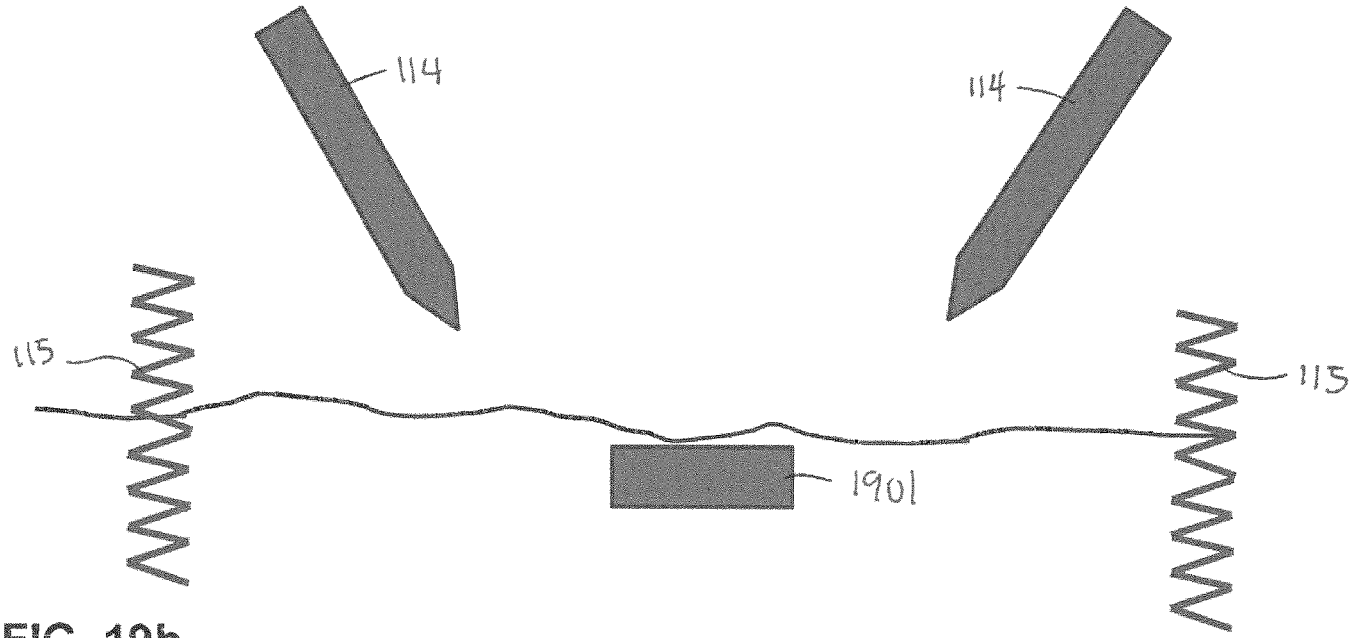
Figure 19C:
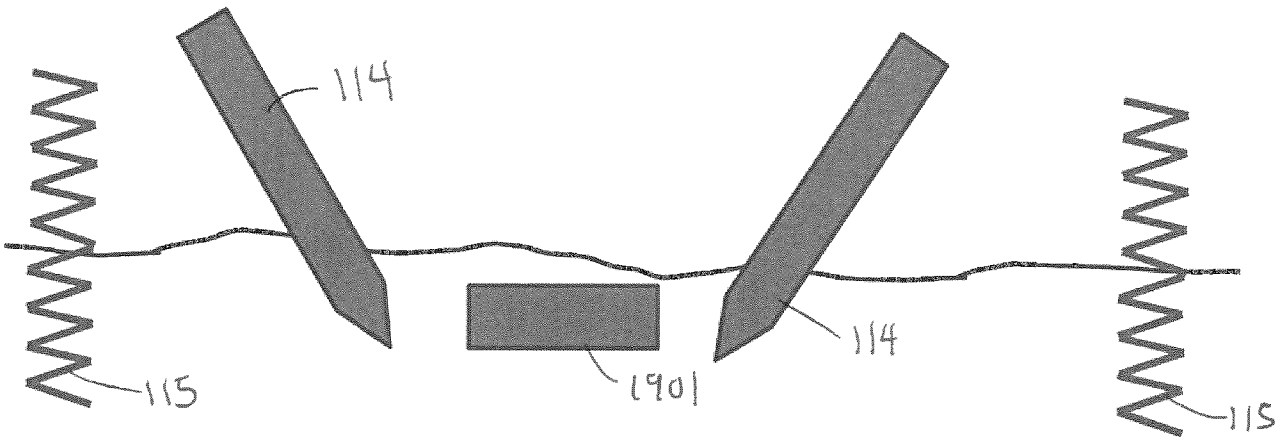
Figure 19D:
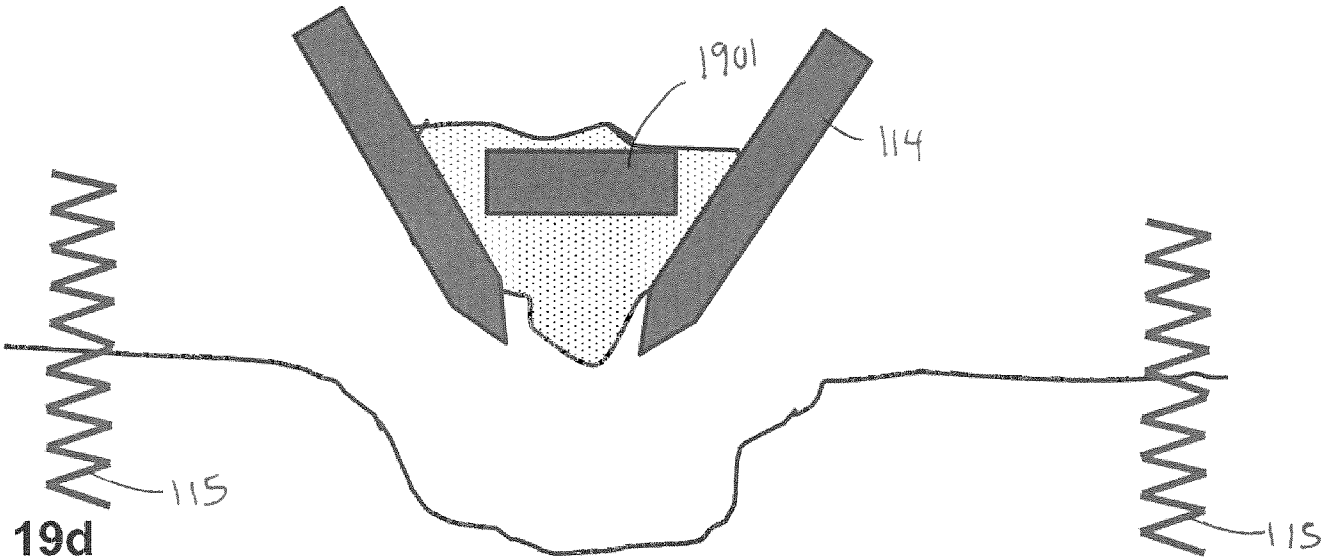

FIGS. 19*a* to 19*d* show different example stages of the excavation process. In FIG. 19*a*, the corkscrews 115 and the drill bits 114 are positioned above the landmine 1901, which is located beneath the ground surface. In FIG. 19*b*, the corkscrews 115 are driven into the ground to provide an anchoring force. In FIG. 19*c*, the drill bits 114 are then driven into the ground and extend underneath the landmine 1901. In FIG. 19*d*, the drill bits 114 are moved upwards to lift up the landmine 1901. The landmine 1901 is now excavated.

In an alternative example, smooth tool tips replace the drill bits 114. The tool tips do not spin, but simply push into the ground.

As noted above, an example embodiment of the system is an autonomous machine, in which the excavator system 100 and the mobile platform 101 are equipped with sensors, processors and memory that stores processor executable instructions to automatically detect landmines underground, to automatically navigate terrain, and to automatically excavate a landmine.

In another example aspect, the memory stores datasets for detecting landmines and machine learning algorithms. The data sets, for example, are obtained by the sensors on the machine 102 that are run through various trials. These datasets are used to train the machine learning algorithm or algorithms. The machine learning algorithms are able to determine the difference between a real landmine and a false positive.

Figure 20:
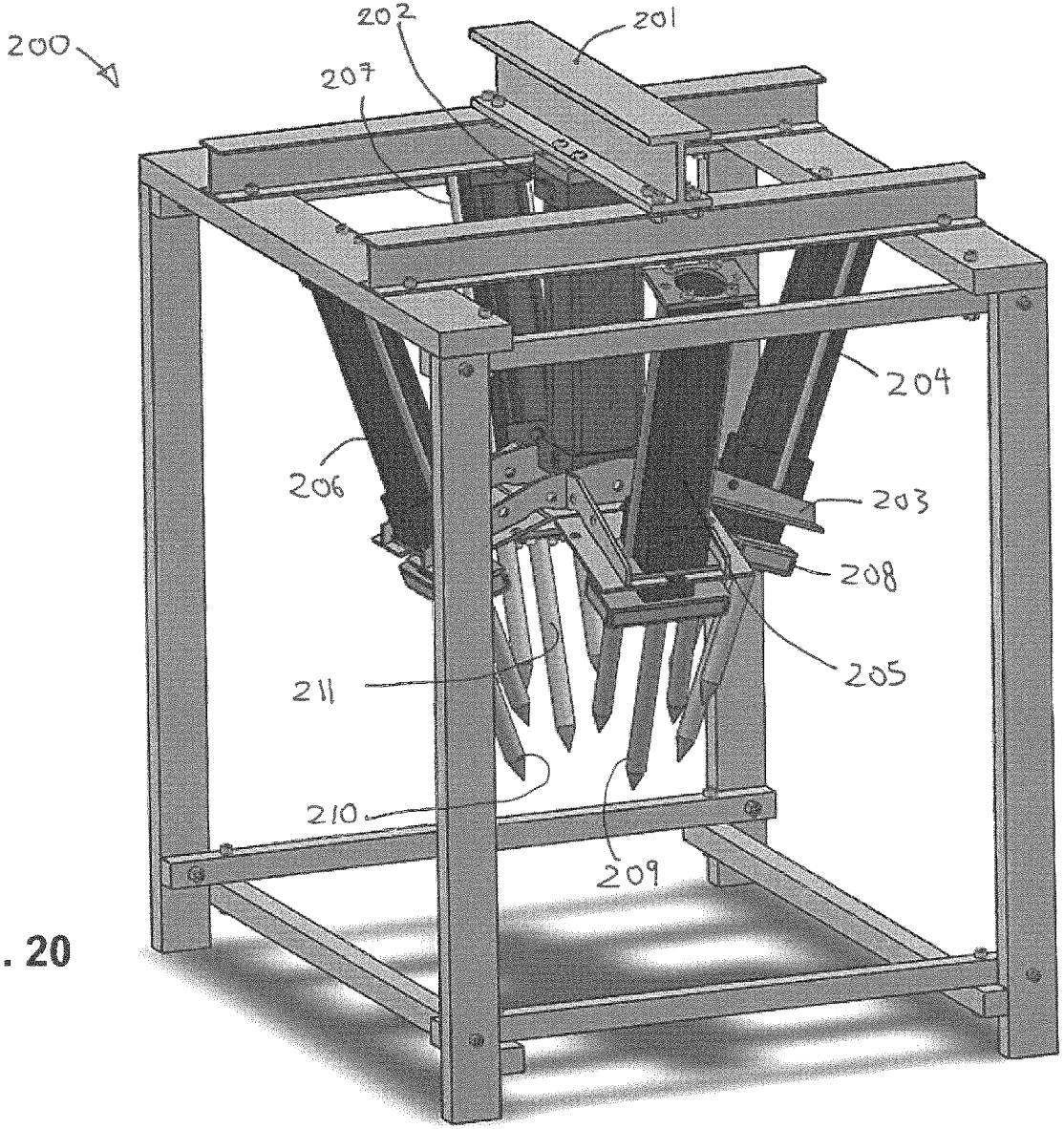
FIG. 20 is another example embodiment of an excavation mechanism.

Turning to FIG. 20, another example embodiment of an excavation system is provided.

In FIG. 20, an excavator 200 that includes a frame 201. The frame 201 can be mounted to a vehicle or a mobile platform. The shape of the frame 201 may vary from what is shown. In general, the frame 201 supports a primary piston or actuator 202. The primary piston 202 has piston rod that is connected to a mounting plate 203. In other words, the mounting plate is able to be moved up and down by the primary piston.

The mounting plate 202 supports multiple secondary pistons 204, 205, 206 and 207. Secondary piston 204 is used to extend a piston rod, which has on its end a tool 208. Similarly, secondary piston 205 can be used to extend and retract the tool 209; secondary piston 206 can be used to extend and retract the tool 210; and secondary piston 207 can be used to extend and retract the tool 211. The tools penetrate the ground surface around a landmine.

In a preferred embodiment, the primary and the second pistons are pneumatic cylinders. However, other types of actuators, such as hydraulic actuators and mechanical actuators may be used.

Although four secondary pistons are shown, it will be appreciated that two or three, or some other number of pistons may be used. In general, two or more tools should be used to surround a landmine, and to pick up the same.

Figure 21:
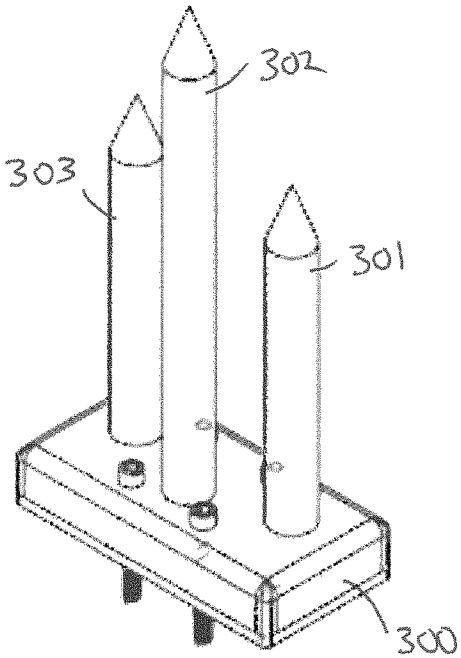
FIG. 21 is an example of a ground penetration tool used in the excavation mechanism.

FIG. 21 shows an example embodiment of a tool (208, 209, 210, 211) in isolation. It includes a base 300, from which three prongs 301, 302, 303 extend. Each prong includes a cylindrical body, having a tip that is conical and ends in a point. The two outer prongs 301, 303 are offset from the middle prong 302. In assembly, the prongs of the multiple tools are positioned to form a circular-like perimeter around a landmine.

The prongs on the tool are shaped to require less force for the prongs to penetrate the ground surface. There is less surface area on the prongs, and therefore, less force is required to push the prongs into the ground surface.

Figure 22A:
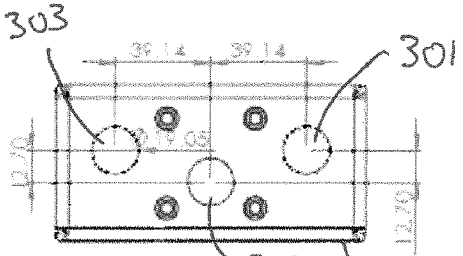
FIGS. 22*a*, 22*b* and 22*c* are different views of the ground penetration tool.
Figure 22B:
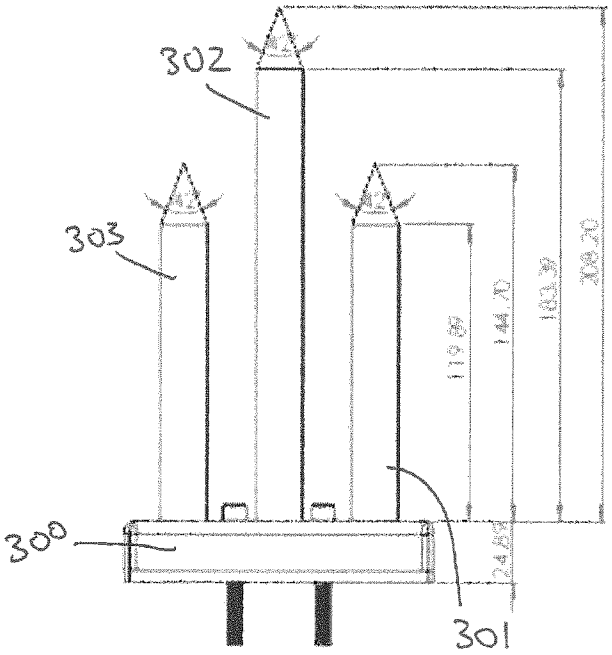
Figure 22C:
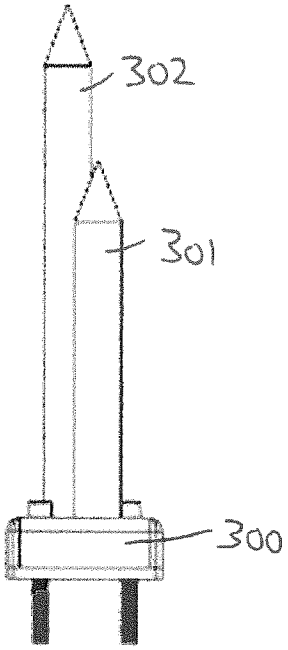

Other views of a tool are shown in FIGS. 22*a*, 22*b*, and 22*c*.

Figure 23:
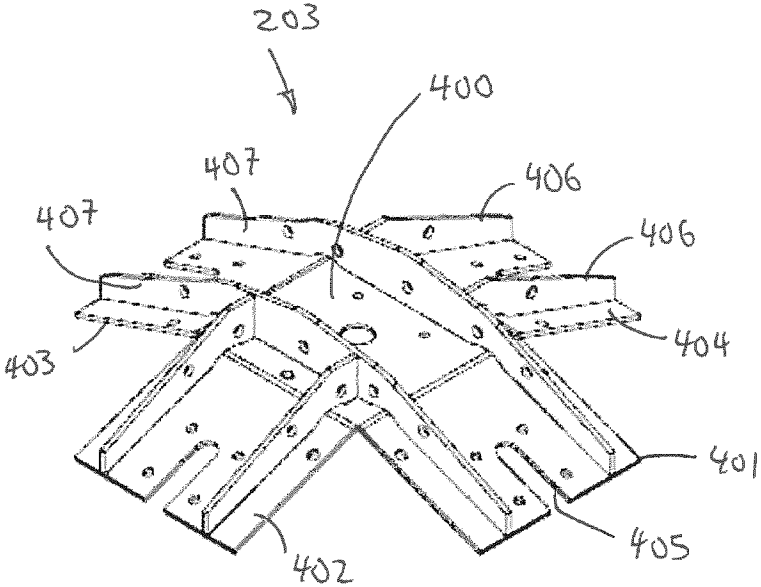
FIG. 23 is an example a mounting plate used to support multiple ground penetration tools.

FIG. 23 shows the mounting plate 203 in isolation. The mounting plate 203 includes a central portion 400, to which the primary piston rod is attached. Extending from the central portion are mounts 401, 402, 403 and 404 that support the secondary pistons 204, 205, 206, and 207.

For example, each mount 401 defines therein an opening 405, such as a slot, to secure a secondary piston. Each of the mounts 401, 402, 403, 404 are angled below the plane defined by the central potion 400. In this way, the secondary pistons and the tools are angled inwards, as best seen in FIG. 20.

Ribs 406 and 407 reinforce the strength of the mounting plate 203.

The prongs of the tools penetrate a ground surface around a landmine. The prongs are extended below and around the landmine. After the prongs are have been extended below and around the landmine, the prongs are retracted vertically upwards, using the primary piston. A portion of the earth may be is retracted with the mine, and that earth may fall through the spaces of the prongs, leaving only the landmine isolated and lifted by the prongs.

Figure 24:
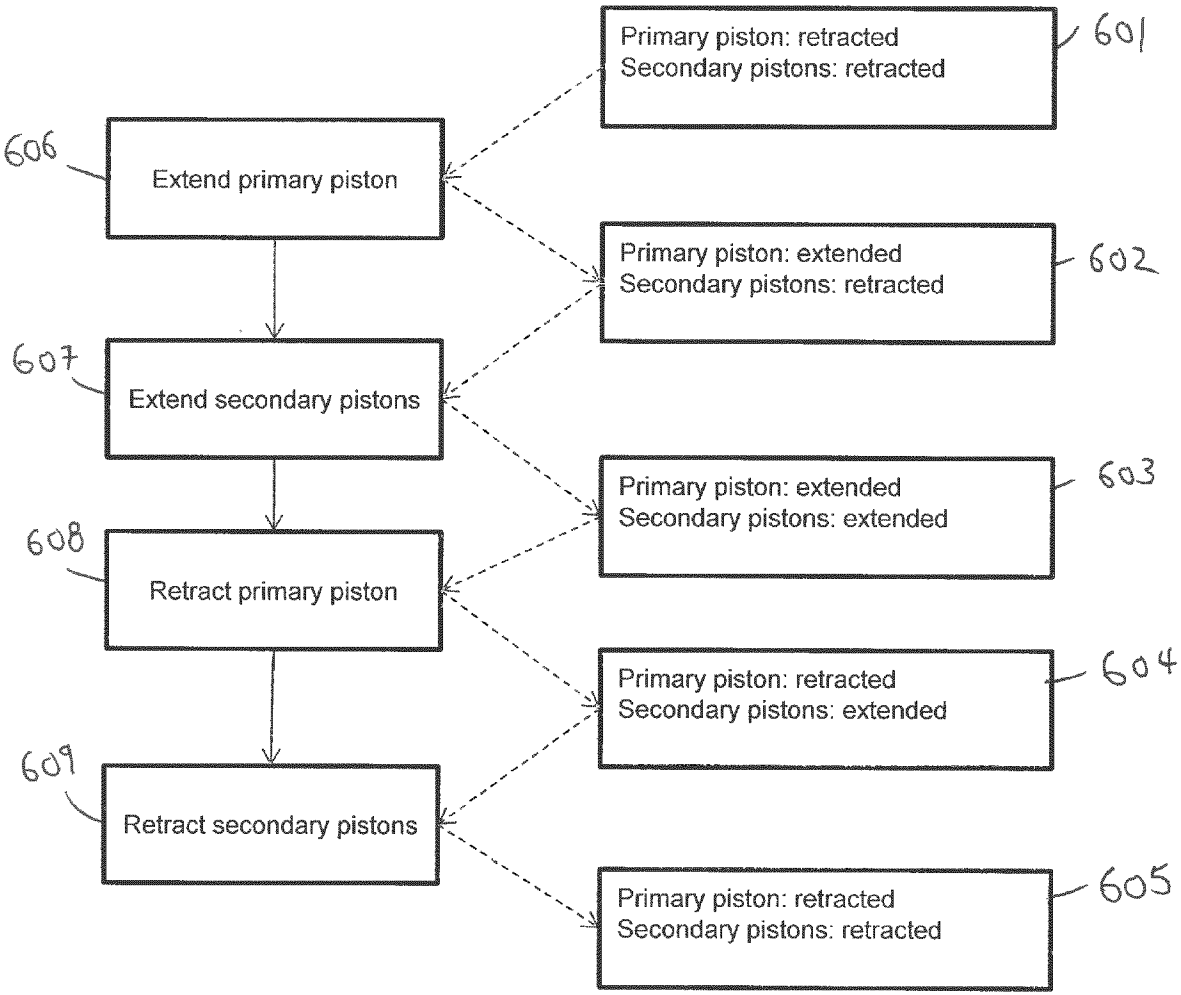
FIG. 24 shows example operations of the excavation mechanism.

FIG. 24 shows an example operation of the excavator 200. It will be appreciated that operation of the excavator is preferably semi-automatic, or fully automatic. A controller, which includes a processor with memory, executes commands to control the pistons. In an example embodiment that uses pneumatic cylinders, the controller is electrically connected to an electro-mechanical controller, which in turn controls the flow of air to pressurize or depressurize the pistons.

In another example, a person may use a manual controller to control the operation of each of the pistons.

Blocks 601-605 show the different states of the excavator. Blocks 606-609 show the different operations, which are executed to transition from one state to another state.

At block 601, the initial state of the excavator is that the primary piston is retracted and the secondary pistons are also retracted.

At block 606, there is a control command to extend the primary piston. Subsequently, the primary piston is in an extended state and the secondary pistons are in a retracted state (block 602). By doing so, the mounting plate is vertically translated downwards. In this state, the tools are positioned close to the ground surface, but have not yet penetrated the ground surface.

At block 607, there is a control command to extend the secondary pistons. Subsequently, the primary piston and the secondary pistons are extended (block 603). By this action, the prongs of the tools extend along a diagonal or angled path into the ground surface. The prongs, at this state, are within the ground and are positioned below and around a landmine.

In an example embodiment, the secondary pistons are extended at the same time.

In another example, one secondary piston is extended into the ground surface at a time. This increases the amount of force being exerted on a tip of a tool, as it penetrates the ground surface. Further, after one tool has been extended into the ground, it acts as an anchor point for the excavator, and helps to hold down the excavator while a subsequent tool is extended into the ground.

At block 608, there is a control command to retract the primary piston. The resulting state is that the primary piston is retracted, while the secondary pistons remain extended (604). In other words, the tools are lifted up in a vertical translation which effectively excavates the landmine from the ground surface. The dirt or soil may pass through the gaps in the prongs, leaving the landmine is isolation.

The secondary pistons are finally commanded to retract (block 609). As a result, the primary pistons are retracted and the secondary pistons are retracted (block 605). The landmine then is released from the prongs.

It will be appreciated that landmines are triggered to explode by typically sensing pressure or some disturbance at a top surface of the landmine. The excavator described herein uses tools that go around and below the landmine, so as not to trigger an explosion of the landmine.

In another example embodiment, a neutralizer is provided to remove the explosive threat of a landmine.

The neutralizer includes a device to pick up the landmine and place the same into a clamp. The clamp uses a threaded rod mechanism (similar to a vice) in order to tighten its grip on the landmine. The vice mechanism provides a tight and constant grip on the landmine without the need for supplying constant power. Once in the grip, a cutter begins to cut an opening in the side of the landmine. The opening in the landmine exposes the explosive material (TNT/composition B). Once exposed, a steaming module is positioned at or in the opening in order to melt out the explosive material.

It is recognized that landmines have two key components: a detonator, and a primary explosive material. It is further recognized that the primary explosive material is typically stable unless exposed to extreme threats (fire, heavy impact, etc.). Therefore, the neutralizer separates the primary explosive material from the detonator, and thereby effectively neutralizing the landmine. The neutralizer uses steam to melt out the explosive material, which means that the temperature will not exceed 100 degrees Celsius, and thus are a reduced risk of triggering the explosive. Not only that, steam is easy to reproduce everywhere (e.g. in field conditions, in remote areas), and does not rely on high-end technology in order to manipulate. Therefore, the neutralizer performs the job safely, and further employs technology and materials that are readily accessible.

Figure 25:
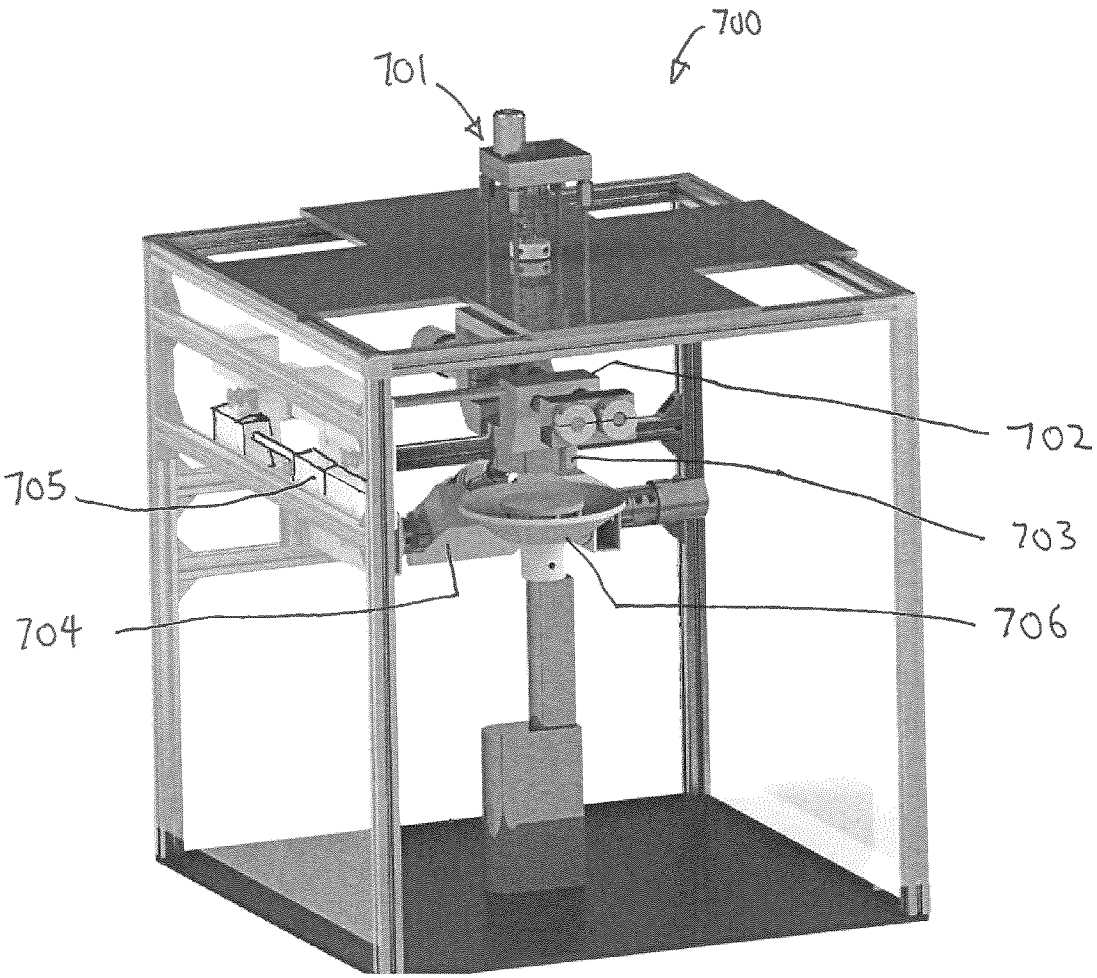
FIG. 25 is an example of a neutralizing mechanism.

Turning to FIG. 25, an example of a neutralizer 700. It will be appreciated that frame and support of the neutralizer may vary based on adaptation, for example, to a vehicle mount or to be used in combination with the excavator. The components and their operations can, therefore, accordingly be repositioned and modified to fit other platform technologies.

The neutralizer includes a rotation module 701 for rotating a clamp 702, which grips onto a landmine 703. The neutralizer also includes a cutter module 704 and a steamer module 705. A catcher 706 is used to catch the melted explosive material.

Figure 26:
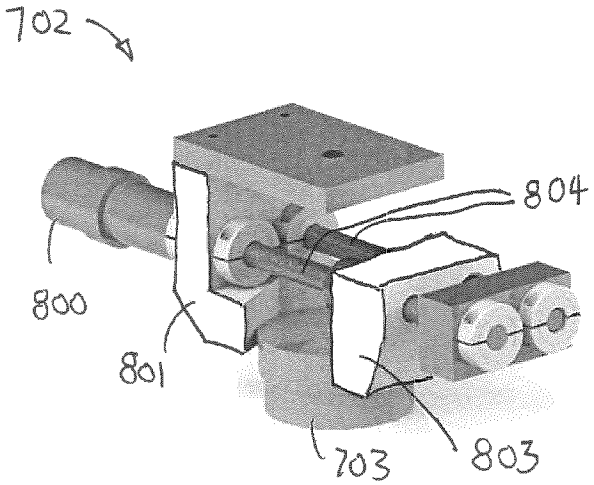
FIG. 26 is an example of a clamping device that is part of the neutralizing mechanism, which is used to clamp onto a landmine.

FIG. 26 shows the clamp 702. It includes an electric motor 800 that drives two worm screws 804, also called threaded rods. The motor 800 is mounted to the block 801, which also includes a first gripping portion 802. Another block having a second gripping portion 803 is threaded, and is able to move along the length of the threaded rods, based on the direction of the rotation of the threaded rods. One or both of the gripping portions 802, 803 can be shaped to better grip onto a landmine. For example, the surface is V-shaped, or has ridges, or is curved in order to improve the amount of contact with the landmine. The clamp is able to maintain grip the landmine without having to electrically power the motor 800.

Figure 27:
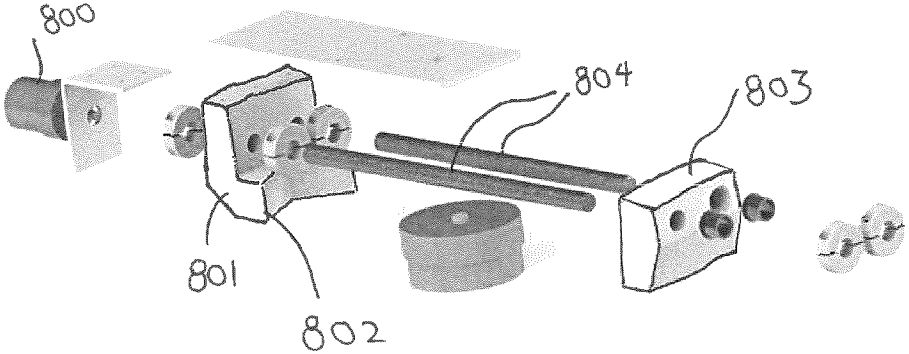
FIG. 27 shows an exploded view of the clamping device.

An exploded view of the clamp is shown in FIG. 27.

Figure 28:
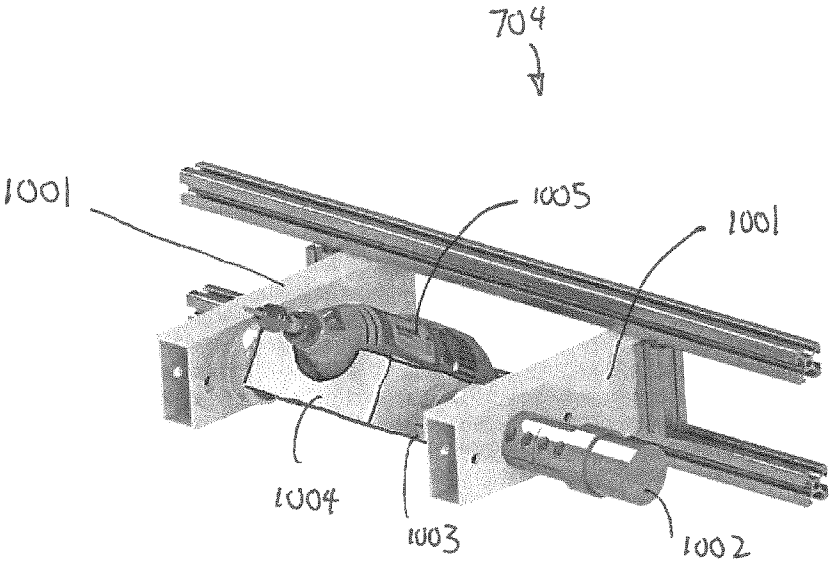
FIG. 28 is an example of a cutting device that is part of the neutralizing mechanism, and which is used to cut an opening into a landmine.

FIG. 28 shows the cutter module 704. It includes mechanical supports 1001, which support an electric motor 1004 and a rod 1003. The rod 1003 supports a cutter carriage 1004, which holds the cutting tool 1005. The electric motor 1004 is able to rotate the angle of the cutting tool 1005, via rotation of the rod 1003. In an example embodiment, the cutting tool is a drill with milling bit. In an example embodiment, the drill is commercially available under the trade name "Dremel". However, other types of tools that can penetrate directly into a landmine, and cut along a surface of the landmine to create an opening, may be used.

In operation, the clamp is used to clamp onto the landmine. The cutter module and the rotation module, which can rotate the clamp and thus the landmine, are then operated in a coordinated manner. In particular, the milling bit drill into the landmine, and then, while the milling bit is spinning, the rotation module rotates the landmine to create a cut along the case of the landmine. The cutter carriage is then rotated downwards or upwards, to cause the milling bit to make a perpendicular downwards or upwards cut. The operations are continued until an opening is made.

Figure 29:
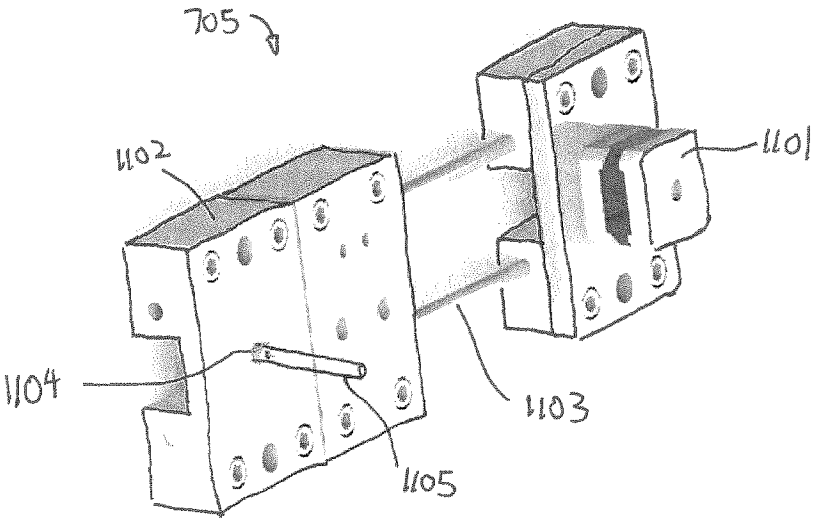
FIG. 29 is an example of a steaming mechanism that is part of the neutralizing mechanism.

Turning to FIG. 29, the steaming module 705 moves to place a steam wand 1105 into the opening of the landmine. The steaming module includes an electric motor 1101 that rotates worm screws, or threaded rods 1103, which in turn causes a steaming block 1102 to move into position. The wand 1105 is connected to a nozzle 1104 on the steaming block 1102.

Figure 30:
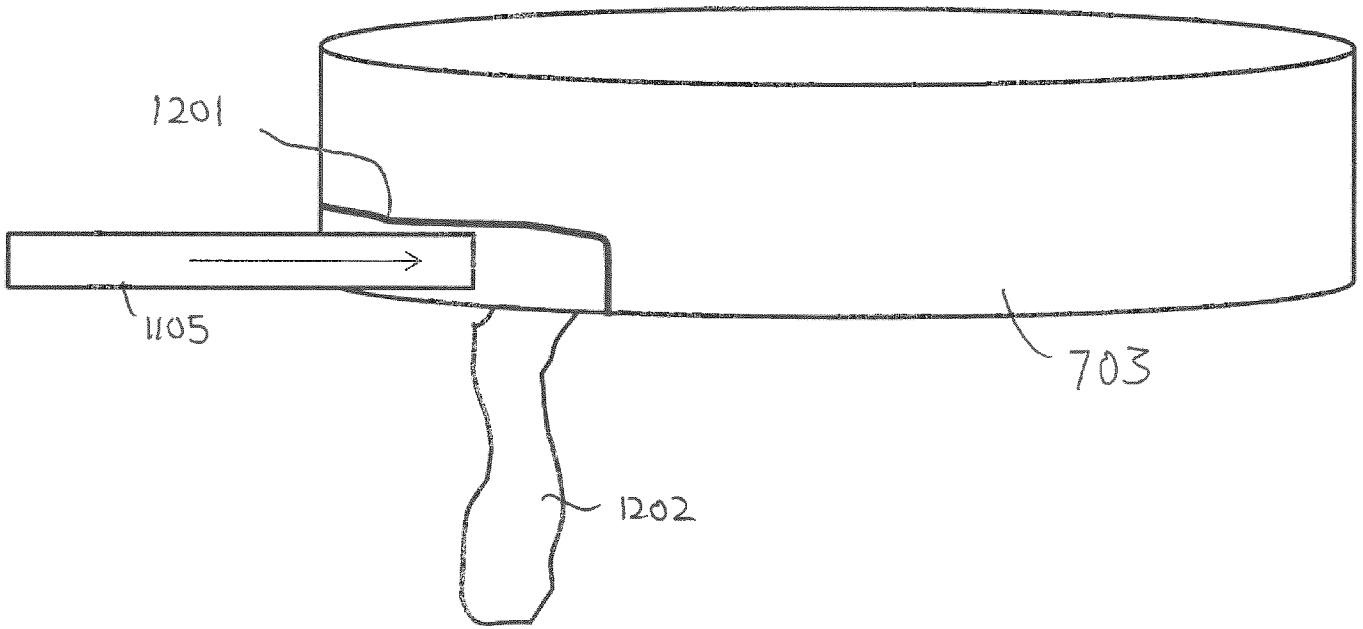
FIG. 30 shows a landmine, which has been cut open, in isolation with a steam wand of the neutralizing mechanism.

In FIG. 30, a landmine 703 is shown with a cut opening 1201. The steam wand 1105 moves into or at the opening 1201, and injects steam into the landmine body. The melted explosive material 1202 then drips downward into a catcher 706.

It will be appreciated that a controller, comprising a processor, memory and a communication device, coordinates and controls the functions of the neutralizer.

Figure 31:
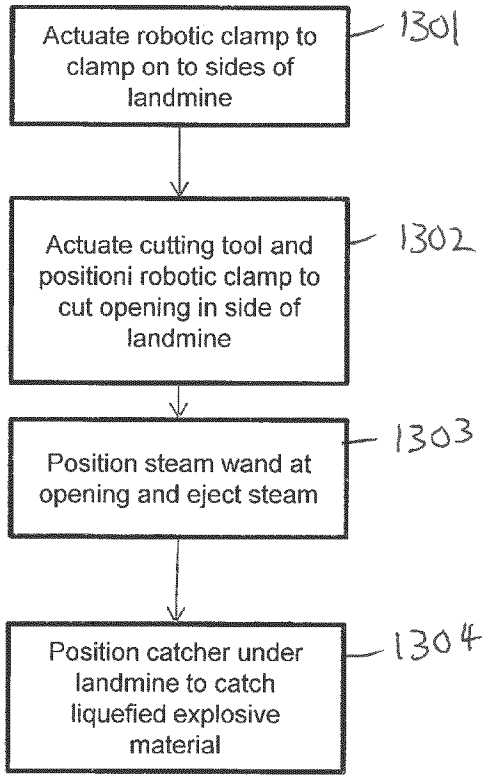
FIG. 31 shows example operations of the neutralizing mechanism.

FIG. 31 shows example processor executable instructions for controlling the neutralizer.

At block 1301, the robotic clamp is actuated to clamp on to the sides of the landmine. At block 1302, a cutting tool is actuated and the robotic clamp is positioned, so that an opening can be cut into the side of the landmine.

At block 1303, the steam wand is positioned into the opening or at the opening, and steam is injected into the landmine.

At block 1304, the catcher is positioned below the landmine to collect the melted explosive material.

Figure 32:
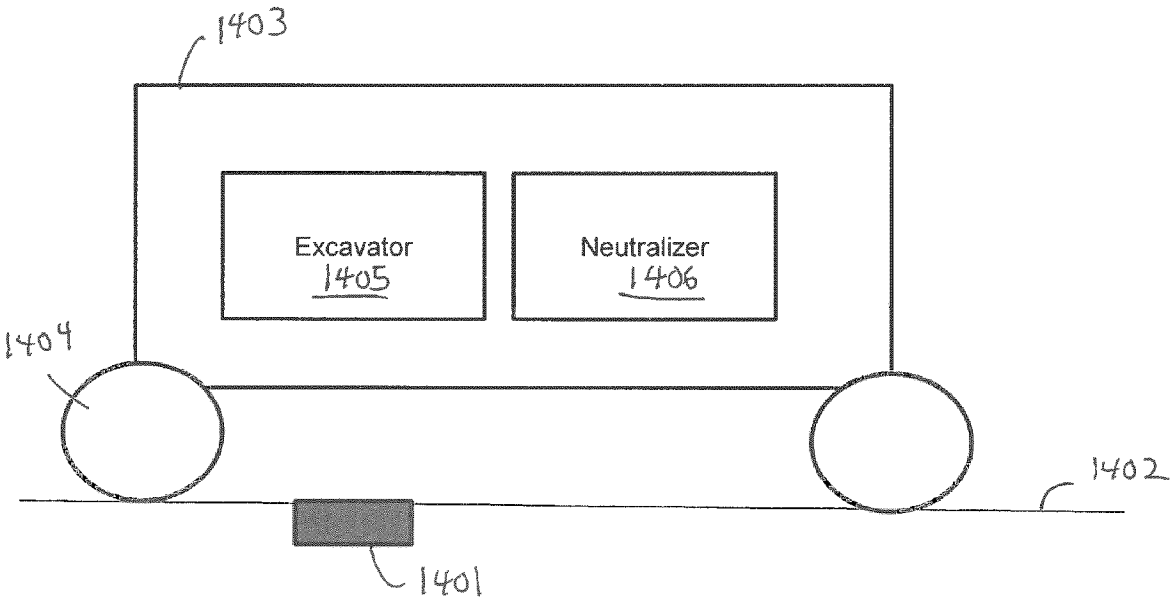
FIG. 32 is an example of a transport system that incorporates an excavator mechanism and a neutralizer mechanism.

Turning to FIG. 32, in an example embodiment, a transporter 1403, which has wheels 1404 or tank treads (e.g. continuous tracks, caterpillar tracks, etc.), carries an excavator 1405 and a neutralizer 1406. The transporter positions the excavator above a landmine 1401, which is located at or just under the ground surface 1402.

The excavator lifts up the landmine from the ground, and then the neutralizer uses its components to neutralize the landmine.

The excavator in FIG. 32, for example, is the excavator system 100 or is the excavator 200, or is some other type of excavator.

The neutralizer in FIG. 32, for example, is the neutralizer 700, or is some other type of neutralizer.

Figure 33:
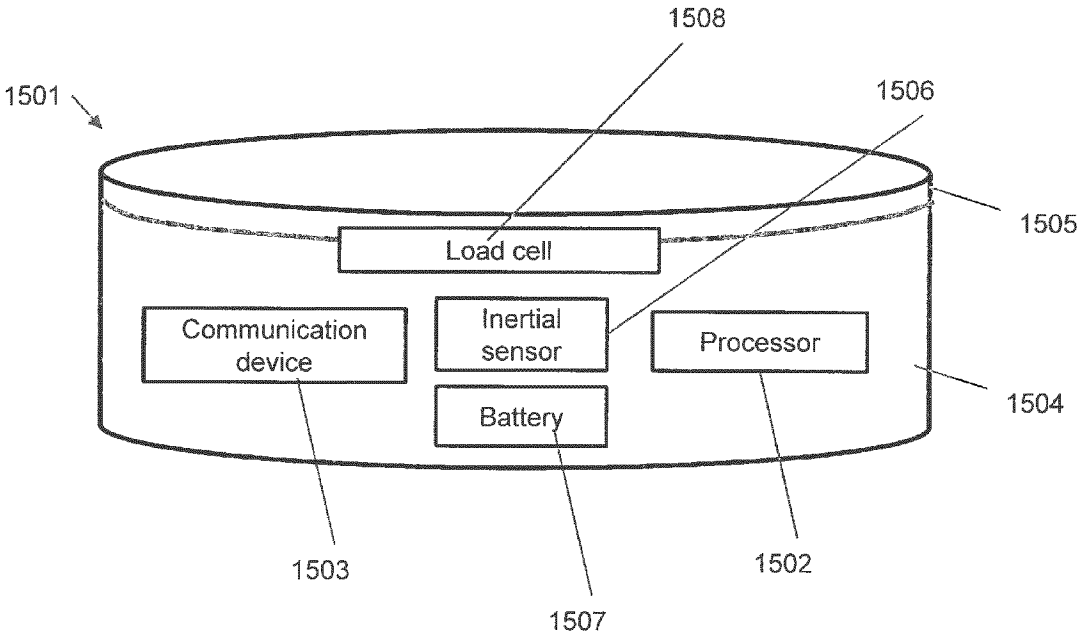
FIG. 33 is an example embodiment system diagram of a mock landmine used for testing and calibration.

Turning to FIG. 33, a mock landmine 1501 is shown. It includes a plastic shell which preferably, although not necessarily, has similar or the same dimensions as currently known landmines (e.g. a PWM-2 landmine). The mock landmine also includes electronics, such as one or more sensors, a processor 1502, a battery 1507 and a communication device 1503. The shell is formed of two pieces, the case 1504 and the pressure plate 1505. In particular, the electronics include: a load cell 1508, an Arduino processor, an inertial sensor 1506 (e.g. a gyroscope or an accelerometer, or both), and a Bluetooth transmitter. The pressure plate is attached to (e.g. screwed onto) the load cell, and it measures the downward force acting on the pressure plate. The force data, and the acceleration data from the gyroscope are sent to the processor. The processor sends that data to the Bluetooth transmitter, which wirelessly communicates with any compatible Bluetooth device.

Figure 34:
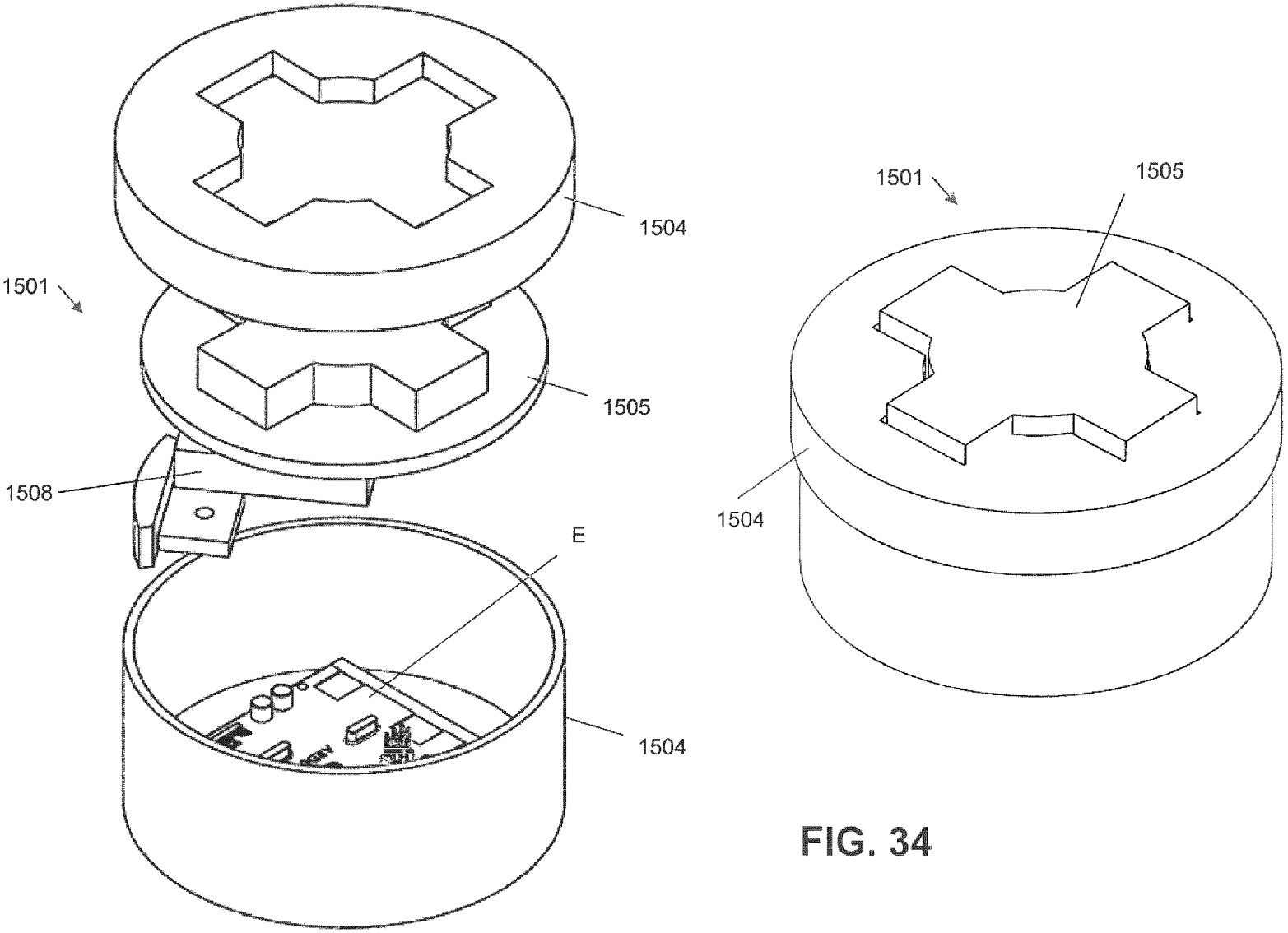
FIG. 34 is another example embodiment of a mock landmine used for testing and calibration, showing both a perspective view and an exploded perspective view.

FIG. 34 shows another example of a mock landmine 1501. It further shows electronics (E) positioned within the shell.

The purpose of the mock landmine is to help test and calibrate the excavator technologies and the neutralizer technologies, since it is not practical to test using actual landmines. For example, PWM-2 landmines detonate when the pressure plate experiences 10 lbs of force. For testing, the mock landmine is buried underneath the ground and it is paired with a Bluetooth compatible user device (e.g. a smart phone, a tablet, a laptop, etc.). The mine constantly sends the force data or the acceleration data, or both, to the user device, and an operations team checks to see if the force is greater than 10 lbs, or some other threshold force. The acceleration data or gyroscope data, or both, could also be used to detect if threshold parameters are exceeded.

Below are non-limiting general example embodiments and related aspects.

In an example embodiment, an excavator for landmines is provided, comprising: a first actuator that vertically moves a mounting plate; and two or more secondary actuators that are supported indirectly or directly to the mounting plate. Each of the secondary actuators acting on a respective tool, and the respective tools are angled downwards and towards each other.

In an example aspect, the excavator further includes two or more drill modules, each of the drill modules respectively housing each of the secondary actuators, wherein each of the secondary actuators linearly push their respective tool.

In another example aspect, each of the each of the drill modules respectively further house a respective motor, the respective motor linked to locally actuate the respective tool.

In another example aspect, the respective tool includes one or more drill bits, and the respective motor is linked to spin the one or more drill bits.

In another example aspect, each of the drill modules comprise a respective drill assembly, the respective drill assembly comprising two support plates that support the respective tool, and two support plates define a hole with a threaded interior; and wherein the respective secondary actuator comprises a motor that drives a threaded rod, and the threaded rod is engaged with the treaded interior so that rotation of the threaded rod drives the respective drill assembly up or down.

In another example aspect, each of the respective tools comprise prongs.

In another example aspect, the first actuator is a piston.

In another example aspect, the first actuator comprises a motor that drives a threaded rod, wherein the threaded rod is engaged with an interior threaded surface of a hole defined within the mounting plate.

In another example aspect, the mounting plate includes a center portion and at least two outer portions that are angled downwards relative to the center portion.

In another example aspect, the excavator further includes at least one land anchor assembly, the at least one land anchor assembly comprising an anchoring tool that embeds into the ground to stabilize the excavator.

In another example aspect, the anchoring tool is a corkscrew, and the land anchor assembly comprises a motor that rotates the corkscrew.

In another example aspect, the land anchor assembly comprises a linear actuator that pushes down on the anchoring tool.

In another example aspect, the land anchor assembly further comprises a spring and a supporting platform, and wherein: the supporting platform supports the anchoring tool; the linear actuator pushes down on the supporting platform and is not fixed to the supporting platform; and the spring is fixed to the supporting platform to exert a pulling force on the supporting platform.

In another example aspect, the excavator further comprises a controller, the controller comprising a processor and memory that stores processor executable instructions, the controller configured to autonomously control the first actuator and the two or more secondary actuators.

In another example aspect, the processor executable instructions comprise: activating the first actuator to move the supporting platform downwards; and subsequently activating the two or more secondary actuators to simultaneously act on their respective tools.

In another general example embodiment, a machine is provided for excavating landmines. The machine includes: a mobile platform that supports an excavator; the excavator comprising a frame mounted to the mobile platform; a first actuator mounted to the frame that vertically moves a mounting plate; and two or more secondary actuators that are supported indirectly or directly to the mounting plate; wherein each of the secondary actuators acting on a respective tool, and the respective tools are angled downwards and towards each other.

In an example aspect, the machine further includes a controller. The controller includes a processor and memory that stores processor executable instructions. The controller is configured to autonomously control the first actuator and the two or more secondary actuators. When the mobile platform is moving, the controller commands the first actuator to be in a retracted state to hold the respective tools above the ground.

In another example aspect, the machine further includes sensors, and wherein the controller is configured to autonomously control the mobile platform and the excavator.

In another example aspect, the mobile platform includes wheels or continuous tracks.

In another general example embodiment, a neutralizer is provided for neutralizing landmines. The neutralizer includes: a robotic clamp to grip a landmine and to reposition the same; a cutting tool to cut an opening into the landmine; a steaming module to eject steam into the opening; and a catcher to collect melted explosive material that exits the landmine.

In an example aspect, the cutting tool comprises a motor driving a drill bit.

In another example aspect, the steaming module comprises an actuator and a steam wand protruding from a body of the steaming module, wherein the actuator acts on the body to position the steam wand.

In another general example embodiment, a system is provided for processing landmines. The system includes: an excavator system that the excavates a landmine; and a neutralizer system that obtain the landmine from the excavator system. The excavator system comprises: a first actuator that vertically moves a mounting plate; and two or more secondary actuators that are supported indirectly or directly to the mounting plate, each of the secondary actuators acting on a respective tool, and the respective tools are angled downwards and towards each other. The neutralizer system comprises: a robotic clamp to grip the landmine from the excavator system and to reposition the same; a cutting tool to cut an opening into the landmine; a steaming module to eject steam into the opening; and a catcher to collect melted explosive material that exits the landmine.

In another general example embodiment, an excavator is provided for excavating landmines. The excavator includes: a frame; a first actuator mounted to the frame that vertically moves a mounting plate; and two drill modules mounted to the mounting plate. Each of the drill modules include: a drilling assembly comprising a motor that drives drilling bits; and a secondary actuator that linearly acts on the drilling assembly. The excavator further includes a land anchor assembly mounted to the frame. The land anchor assembly includes an anchoring tool that embeds into the ground to stabilize the excavator; and the respective drilling bits of the respective drill modules are angled downwards and towards each other.

In an example aspect of the excavator, the anchoring tool is a corkscrew, and the land anchor assembly comprises a motor that rotates the corkscrew.

In another example aspect, the land anchor assembly comprises a linear actuator that pushes down on the anchoring tool.

In another example aspect, the land anchor assembly further comprises a spring and a supporting platform. The supporting platform supports the anchoring tool. The linear actuator pushes down on the supporting platform and is not fixed to the supporting platform. The spring is fixed to the supporting platform to exert a pulling force on the supporting platform.

In another example aspect, the first actuator is a piston.

In another example aspect, the first actuator comprises a motor that drives a threaded rod, wherein the threaded rod is engaged with an interior threaded surface of a hole defined within the mounting plate.

In another example aspect, the mounting plate includes a center portion and at least two outer portions that are angled downwards relative to the center portion, and the two drill portions are positioned on the at least two outer portions.

In another general example embodiment, a mock landmine is provided. It includes: a shell comprising a case and a pressure plate; a load cell positioned within the shell and attached to the pressure plate to measure force on the pressure plate; and a processor and a communication device positioned with the shell, the processor in data communication with the load cell and the communication device. The processor receives force data from the load cell and the communication device transmits the force data.

In an example aspect, the mock landmine further includes an inertial measurement sensor positioned within the shell. The processor receives inertial data from the inertial measurement sensor and the communication device transmits the inertial data.

In another example aspect, the communication device wirelessly transmits the force data.

It will also be appreciated that while the excavators are described in reference to excavating landmines, the excavators can also be used to excavate other objects (e.g. explosives, chemicals, rocks, electronics, other devices, etc.), not necessarily limited to landmines.

The schematics and block diagrams used herein are just for example. Different configurations and names of components can be used. For instance, components and modules can be added, deleted, modified, or arranged with differing connections without departing from the spirit of the invention or inventions. It will also be appreciated that the components and modules described herein with respect to the excavator technologies or the neutralizer technologies, or both, may be combined in different configurations, even if these combinations are not explicitly described.

The steps or operations in the flow charts and diagrams described herein are just for example. There may be many variations to these steps or operations without departing from the spirit of the invention or inventions. For instance, the steps may be performed in a differing order, or steps may be added, deleted, or modified.

It will be appreciated that the particular embodiments shown in the figures and described above are for illustrative purposes only and many other variations can be used according to the principles described. Although the above has been described with reference to certain specific embodiments, various modifications thereof will be apparent to those skilled in the art as outlined in the appended claims.

The invention claimed is:

1. An excavator for landmines, comprising:

a first actuator that vertically moves a mounting plate;

two or more secondary actuators that are supported indirectly or directly by the mounting plate, each of the secondary actuators acting on a respective tool, and the respective tools are angled downwards and towards each other; and two or more drill modules, each of the drill modules respectively housing each of the secondary actuators;

wherein each of the secondary actuators linearly push their respective tool.

2. The excavator of claim 1 wherein each of the each of the drill modules respectively further house a respective motor, the respective motor linked to locally actuate the respective tool.

3. The excavator of claim 2 wherein the respective tool includes one or more drill bits, and the respective motor is linked to spin the one or more drill bits.

4. The excavator of claim 1 wherein each of the drill modules further comprise a respective drill assembly, the respective drill assembly comprising two support plates that support the respective tool, and two support plates define a hole with a threaded interior;

wherein the respective secondary actuator comprises a motor that drives a threaded rod, and the threaded rod is engaged with the treaded interior so that rotation of the threaded rod drives the respective drill assembly up or down.

5. The excavator of claim 1 wherein each of the respective tools comprise prongs.

6. The excavator of claim 1 wherein the first actuator is a piston.

7. The excavator of claim 1 wherein the first actuator comprises a motor that drives a threaded rod, wherein the threaded rod is engaged with an interior threaded surface of a hole defined within the mounting plate.

8. The excavator of claim 1 wherein the mounting plate includes a center portion and at least two outer portions that are angled downwards relative to the center portion.

9. The excavator of claim 1 further comprising at least one land anchor assembly, the at least one land anchor assembly comprising an anchoring tool that embeds into the ground to stabilize the excavator.

10. The excavator of claim 9 wherein the anchoring tool is a corkscrew, and the land anchor assembly comprises a motor that rotates the corkscrew.

11. The excavator of claim 9 wherein the land anchor assembly comprises a linear actuator that pushes down on the anchoring tool.

12. The excavator of claim 11 wherein the land anchor assembly further comprises a spring and a supporting platform, and wherein: the supporting platform supports the anchoring tool; the linear actuator pushes down on the supporting platform and is not fixed to the supporting platform; and the spring is fixed to the supporting platform to exert a pulling force on the supporting platform.

13. The excavator of claim 1 further comprising a controller, the controller comprising a processor and memory that stores processor executable instructions, the controller configured to autonomously control the first actuator and the two or more secondary actuators.

14. The excavator of claim 13 wherein the processor executable instructions comprise: activating the first actuator to move the supporting platform downwards; and subsequently activating the two or more secondary actuators to simultaneously act on their respective tools.

15. A machine for excavating, comprising:

a mobile platform that supports an excavator;

the excavator comprising a frame mounted to the mobile platform;

a first actuator mounted to the frame that vertically moves a mounting plate;

two or more secondary actuators that are supported indirectly or directly by the mounting plate, each of the secondary actuators respective tool, and the respective tools are angled downwards and towards each other; and two or more drill modules, each of the drill modules respectively housing each of the secondary actuators;

wherein each of the secondary actuators linearly push their respective tool.

16. The machine of claim 15 further comprising a controller, the controller comprising a processor and memory that stores processor executable instructions, the controller configured to autonomously control the first actuator and the two or more secondary actuators, and wherein when the mobile platform is moving, the first actuator is in a retracted state to hold the respective tools above the ground.

17. The machine of claim 15 further comprising sensors, and wherein the controller is configured to autonomously control the mobile platform and the excavator.

18. The machine of claim 15 wherein the mobile platform includes wheels or continuous tracks.

* * * * *